US010783750B2

(12) United States Patent
Arnone et al.

(10) Patent No.: US 10,783,750 B2
(45) Date of Patent: Sep. 22, 2020

(54) SPORTS EVENT DRIVEN SKILL WAGERING INTERLEAVED GAME

(71) Applicant: Gamblit Gaming, LLC, Glendale, CA (US)

(72) Inventors: Miles Arnone, Sherborn, MA (US); Eric Meyerhofer, Pasadena, CA (US); Caitlyn Ross, Watertown, MA (US); Frank Cire, Pasadena, CA (US); Clifford Kaylin, Los Angeles, CA (US)

(73) Assignee: Gamblit Gaming, LLC, Monrovia, CA (US)

( * ) Notice: Subject to any disclaimer, the term of this patent is extended or adjusted under 35 U.S.C. 154(b) by 955 days.

(21) Appl. No.: 14/985,107

(22) Filed: Dec. 30, 2015

(65) Prior Publication Data

US 2016/0110965 A1 Apr. 21, 2016

Related U.S. Application Data

(63) Continuation of application No. PCT/US2014/044970, filed on Jun. 30, 2014.

(60) Provisional application No. 61/856,175, filed on Jul. 19, 2013, provisional application No. 61/841,411, filed on Jun. 30, 2013.

(51) Int. Cl.
*G07F 17/32* (2006.01)

(52) U.S. Cl.
CPC ..... *G07F 17/3288* (2013.01); *G07F 17/326* (2013.01); *G07F 17/3244* (2013.01)

(58) Field of Classification Search
CPC ..... G07F 17/34
See application file for complete search history.

(56) References Cited

U.S. PATENT DOCUMENTS

2012/0322545 A1* 12/2012 Arnone ..... G07F 17/3272 463/25
2015/0238873 A1* 8/2015 Arnone ..... A63F 13/828 463/25

* cited by examiner

*Primary Examiner* — Robert T Clarke, Jr.
(74) *Attorney, Agent, or Firm* — Frank Cire

(57) ABSTRACT

Systems and methods for operating a sports event driven skill wagering interleaved game are disclosed. A sports event driven skill wagering interleaved game is provides a sports event driven entertainment game and a gambling game. The sports event driven entertainment game is provided by an entertainment system and is managed by a game world operating system. The gambling game is provided by a real credit operating system. The sports event driven entertainment game provided by the entertainment system monitors a sporting event to detect actions that occur during play of the sporting event and generates sports update information that identifies an action that has occurred. The entertainment system provides the game update information to the game world operating that uses game update information to determine whether an action that occurred during the sports events triggers a gambling event in a gambling game. In response to a determination that a gambling event being triggered, the game world operating system sends a trigger to the real credit operating system to perform a gambling event in the gambling game. The real credit operating system then performs the gambling event and resolves any wagers on the outcome of the gambling event.

11 Claims, 19 Drawing Sheets

SPORTS EVENT DRIVEN SKILL WAGERING INTERLEAVED GAME

CROSS REFERENCE TO RELATED APPLICATIONS

The current application is a continuation of Patent Cooperation Treaty Application No. PCT/US14/44970, filed Jun. 30, 2014, which claims the benefit of U.S. Provisional Patent Applications 61/841,411 filed Jun. 30, 2013 and 61/856,175 filed Jul. 19, 2013, the contents of both of which are hereby incorporated by reference. This application is related to Patent Cooperation Treaty Application No. PCT/US11/26768, filed Mar. 1, 2011, entitled ENRICHED GAME PLAY ENVIRONMENT (SINGLE and/or MULTI-PLAYER) FOR CASINO APPLICATIONS, now U.S. Pat. No. 8,632,395 issued Jan. 21, 2014, Patent Cooperation Treaty Application No. PCT/US11/63587, filed Dec. 6, 2011, entitled ENHANCED SLOT-MACHINE FOR CASINO APPLICATIONS and published as US Patent Application Publication No. 2013/0296021 A1, and Patent Cooperation Treaty Application No. PCT/US12/58156, filed Sep. 29, 2012, now U.S. Pat. No. 8,790,170, issued Jul. 29, 2014, and U.S. Pat. No. 8,944,899, issued Feb. 3, 2015, and US Patent Application Publication No. 2015/0141128 A1, the contents of each of which are hereby incorporated by reference.

FIELD OF THE INVENTION

Embodiments of the present invention are generally related to gaming and more specifically to a mechanism by which events that take place within organized sporting events, additional information, and/or other inputs are monitored to initiate gambling events in gambling games.

BACKGROUND

The gaming machine manufacturing industry has traditionally developed gaming machines with a gambling game. A gambling game is typically a game of chance, which is a game where the outcome of the game is generally dependent solely on chance (such as a slot machine). A game of chance can be contrasted with a game of skill where the outcome of the game can depend upon a player's skill playing the game. Gambling games are typically not as interactive as skill games and do not include graphics as sophisticated as the graphics presented in a skill game, such as a video game provided for entertainment.

SUMMARY OF THE INVENTION

Systems and methods in accordance with embodiments of the invention provide a sports event driven skill wagering interleaved game. A casino electronic game machine providing a sports event driven skill wagering interleaved game that includes a sports event driven entertainment game and a gambling game in accordance with some embodiments of the invention may include a real credit operating system comprising: a real world credit meter; a random number generator; a real world credit pay table, where the real credit operating system is configured to: receive real world credit from a portable media, where the portable media includes at least one member of a group including currency, a voucher and a smart card; and provide a randomly generated payout of real world credits from a wager of real world credits in the gambling game using the random number generator and real world credit pay table; and augment an amount of real world credits stored in the real world credit meter based on the randomly generated payout of real world credits to the real world credit meter; an entertainment game system constructed to: monitor a sporting event with the sports event driven entertainment game to detect an occurrence of an action in the sporting event; generate sports event update information that indicates the occurrence of the action in the sporting event; and provide the sports event update information to a game world operating system; a display screen configured to display at least one of the gambling game results and wager outcomes based upon gambling event information; a user input device configured to receive from a player a wagering amount to use during game play; and the game world operating system constructed to: receive, from the entertainment game system, the sports event update information; determine whether a gambling event is triggered from the occurrence of the action in the sporting event based upon the sports update information; and provide, to the real credit operating system, a trigger for the gambling event in response to a determination that the gambling event is triggered.

In accordance with many embodiments, the real credit operating system is further configured to provide, to the game world operating system, gambling event outcome information wherein the gambling event outcome information includes at least one of a gambling event result and the wager outcome.

In accordance with various embodiments, the entertainment game system is further constructed to: receive an input of gambling game options from a user where the gambling game options identify an action in the sporting event; provide, to the game world operating system, the gambling game options received; and receive, from the game world operating system, gambling event outcome information.

In accordance with numerous embodiments, the game world operating system is further constructed to: generate a trigger for the gambling event in the gambling game based upon the action identified in the gambling game options; and provide, to the entertainment game system, the gambling event outcome information.

In accordance with many embodiments, the gambling game options include one of a plurality of gambling games to associate with the action and where the trigger generated by the game world operating system for the gambling event also identifies the one of the plurality of gambling games for which the gambling event is triggered.

In accordance with various embodiments, the gambling game options include a wager amount to wager on the result of the gambling event triggered by the action and wherein the trigger generated by the game world operating system for the gambling event also includes the wager amount for the triggered gambling event.

In accordance with numerous embodiments, the gambling game options includes a plurality of actions for the sporting event and a particular one of a plurality of gambling games to associate with each of the plurality of actions wherein the trigger generated by the game world operating system includes one of the plurality of actions and the particular one of the gambling games associated with the action.

DETAILED DESCRIPTION

Figure 1:
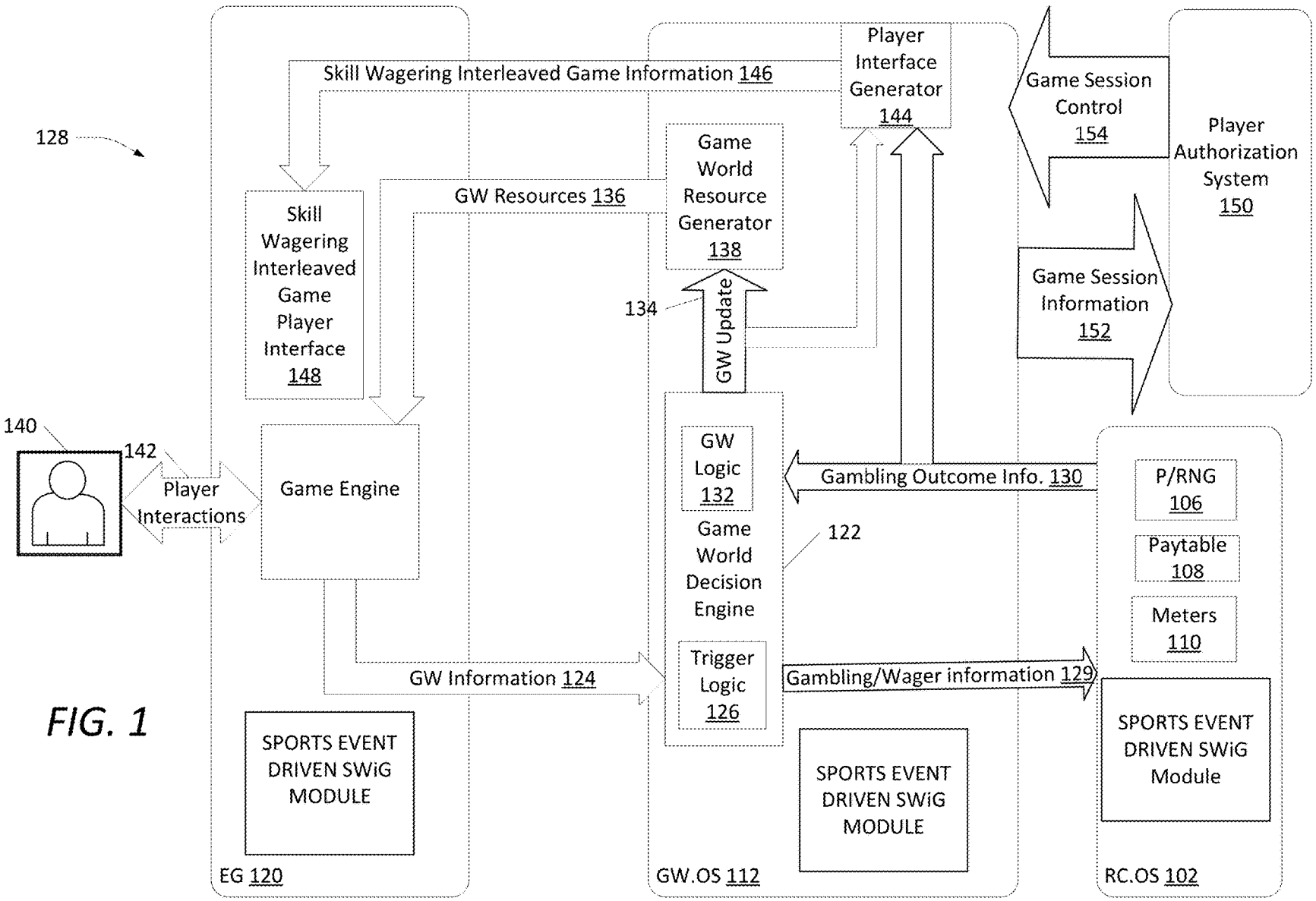
FIG. 1 illustrates a system diagram of a sports event driven skill wagering interleaved game in accordance with an embodiment of the invention.

Turning now to the drawings, systems and methods for operation of sports event driven skill wagering interleaved games are illustrated. In several embodiments, a sports event driven skill wagering interleaved game is a form of a combined skill and wagering game that integrates both a gambling game and a skill-based entertainment game. The gambling game is provided by a real credit operating system (RC.OS) which manages the gambling game. A sports event driven entertainment game system (EG) executes the skill-based components of the sports event driven skill wagering interleaved game entertainment game for user entertainment. The EG is coupled to the RC.OS by a game world operating system (GW.OS). The GW.OS manages the configuration of the sports event driven skill wagering interleaved game entertainment game. In certain embodiments, the sports event driven skill wagering interleaved game also includes a player interface that is associated with either one or both of the RC.OS providing the gambling game and the EG providing the sports event driven entertainment game. For purposes of the discussion, a player or player interactions are represented in a sports event driven skill wagering interleaved game by the electronic representation of interactions between the player and the game, typically received via the player interface, and a player profile of the sports event driven skill wagering interleaved game associated with the player.

In operation of a sports event driven skill wagering interleaved game, a player acts upon various types of elements of a sports event driven entertainment game in a game world environment. Elements are limited resources consumed within a sports event driven entertainment game to advance entertainment game gameplay. During gameplay of the sports event driven entertainment game using the elements, a player can optionally consume and/or accrue game world credits (GWC) within the sports event driven entertainment game. These GWC credits can be in the form of, but are not limited to, game world credits, experience points, and points generally. Wagers can be made on the outcome of gambling events in the gambling game as triggered by the player's use of one or more elements of the sports event driven entertainment game. The wagers may be made using real world credits (RC). The real world credits can be credits in an actual currency, or can be credits in a virtual currency that may or may not have a real world value. The outcomes of gambling events in the gambling game can cause consumption, loss or accrual of RC. In accordance with some embodiments, the outcomes of gambling events in the gambling game can influence elements in the sports event driven entertainment game such as, but not limited to, restoring a consumed element; causing the loss of an element; and restoration or placement of a fixed element. In many embodiments, the gambling games can facilitate a wager of GWC for a randomly generated payout of sports event driven entertainment game GWC or elements on the outcome of a gambling event in a gambling game. The payout for a wager of entertainment game GWC or elements may include a randomly generated payout of elements in accordance with some embodiments. In a number of embodiments, an amount of GWC and/or elements used as part of a wager can have a RC value if cashed out during and/or at the end of a sports event driven skill wagering interleaved game gameplay session.

Example elements of elements in a sports event driven entertainment game include enabling elements (EE) which are elements that enable a player's play of the sports event driven entertainment game and whose consumption by the player while playing the sports event driven entertainment game can trigger a wager in a gambling game. Another, non-limiting, example of an element in a sports event driven entertainment game is a reserve enabling element (REE), which is an element that converts into one or more enabling elements upon occurrence of a release event during sports event driven skill wagering interleaved game gameplay. Yet another, non-limiting, example of element of a sports event driven entertainment game is an actionable element (AE) which is an element that is acted upon during gameplay of the sports event driven entertainment game to trigger a wager in the gambling game; and may or may not be restorable during normal play of the sports event driven entertainment game. Still another, non-limiting, example of an element in a sports event driven entertainment game is a common enabling element (CEE) which is an element that may be shared by two or more players and causes a gambling event and associated wager to be triggered in the gambling game when used by one of the players during play of the sports event driven entertainment game. In progressing through sports event driven entertainment game gameplay, elements can be utilized by a player during interactions with a controlled entity (CE). A CE is a character, entity, inanimate object, device or other object under control of a player.

In accordance with some embodiments of a sports event driven skill wagering interleaved game, gameplay of the sports event driven entertainment game progresses triggering gambling events and associated wagers on the outcome of the gambling event in the gambling game. The triggering of the gambling event and/or wager can be dependent upon a game world variable such as, but not limited to: a required game object (RGO), a required environmental condition (REC), or a controlled entity characteristic (CEC). A RGO is a specific game object in a sports event driven entertainment game acted upon for an AE to be completed. A non-limiting example of an RGO is a specific key needed to open a door. A REC is a game state present within a sports event driven entertainment game for an AE to be completed. A non-limiting example of an REC is daylight whose presence enables a character to walk through woods. A CEC is a status of the CE within a sports event driven entertainment game for an AE to be completed. A non-limiting example of a CEC is requirement that a CE have full health points before entering battle. Although various gameplay resources such as, but not limited to, GWC, RC and elements as discussed above may be used to trigger a gambling event and/or wager in a gambling game, one skilled in the art will recognize that any gameplay resource can be utilized to advance sports event driven skill wagering interleaved game gameplay as well as form the basis for a trigger of a wager as appropriate to the specification of a specific application in accordance with various embodiments of the invention. Various skill wagering interleaved games are discussed in Patent Cooperation Treaty Application No. PCT/US11/26768, filed Mar. 1, 2011, entitled ENRICHED GAME PLAY ENVIRONMENT (SINGLE and/or MULTI-PLAYER) FOR CASINO APPLICATIONS, now U.S. Pat. No. 8,632,395 issued Jan. 21, 2014, and Patent Cooperation Treaty Application No. PCT/US11/63587, filed Dec. 6, 2011, entitled ENHANCED SLOT-MACHINE FOR CASINO APPLICATIONS and published as US Patent Application Publication No. 2013/0296021 A1, each disclosure of which is hereby incorporated by reference in its entirety.

In many embodiments, a sports event driven skill wagering interleaved game integrates a sports event driven entertainment game with a gambling game. In several embodiments, a sports event driven skill wagering interleaved game can utilize a GW.OS to monitor gameplay of the sports event driven entertainment game executed by an EG for a trigger of a gambling event. The trigger for gambling event can be detected from the skillful execution of the sports event driven entertainment game in accordance with at least one gambling event occurrence rule. The trigger of the gambling event can be communicated to a RC.OS. In response to notification of the trigger, the RC.OS triggers a gambling event and a RC wager on the outcome of the gambling event that is made in accordance with a wager trigger rule within the gambling game executed by the RC.OS. The wager can produce a wager payout as a randomly generated payout of both RC and gameplay resources. In addition, gameplay of a sports event driven entertainment game in a sports event driven skill wagering interleaved game can be modified by the GW.OS upon the wager payout. In various embodiments, sports event driven entertainment game gameplay can advance through the performance of sports event driven skill wagering interleaved game player actions. For purposes of this discussion, a game player action is an action during sports event driven skill wagering interleaved game gameplay that can be performed by a player or to a player.

In several embodiments, a gambling event occurrence can be determined from one or more game world variables within a sports event driven entertainment game that are used to trigger a gambling event and/or associated wager in a gambling game. Game world variables can include, but are not limited to, passage of a period of time during sports event driven skill wagering interleaved game entertainment game gameplay; a result from a sports event driven skill wagering interleaved game entertainment game gameplay session (such as, but not limited to, achieving a goal or a particular score); a player action that is a consumption of an element; or a player action that achieves a combination of elements to be associated with a player profile.

In numerous embodiments, a sports event driven entertainment game modification is an instruction of how to modify sports event driven entertainment game gameplay resources based upon one or more of a gambling game payout and game world variables. A sports event driven entertainment game modification can modify any aspect of a sports event driven entertainment game, such as, but is not limited to, an addition of a period of time available for a current gameplay session for the sports event driven entertainment game of sports event driven skill wagering interleaved game, an addition of a period of time available for a future sports event driven skill wagering interleaved game entertainment game gameplay session or any other modification to the sports event driven entertainment game elements that can be utilized during entertainment game gameplay. In some embodiments, a sports event driven entertainment game modification can modify a type of element whose consumption triggers a gambling event occurrence. In many embodiments, a sports event driven entertainment game modification can modify a type of element whose consumption is not required in a gambling event occurrence.

In a number of embodiments, a player interface can be utilized that depicts a status of the sports event driven entertainment game in the sports event driven skill wagering interleaved game. A player interface can depict any aspect of a sports event driven entertainment game including, but not limited to, an illustration of sports event driven skill wagering interleaved game entertainment game gameplay advancement as a player plays the sports event driven skill wagering interleaved game.

Sports Event Driven Skill Wagering Interleaved Games

In many embodiments, a sports event driven skill wagering interleaved game integrates high-levels of entertainment content from a sports event driven entertainment game (game of skill) and a gambling experience from a game of chance (gambling game). A sports event driven skill wagering interleaved game provides for random gambling game outcomes that are independent of player skill while providing a gaming experience (as measured by obstacles/challenges encountered, time of play and other factors) shaped by the player's skill. A sports event driven skill wagering interleaved game in accordance with an embodiment of the invention is illustrated in FIG. 1. The sports event driven skill wagering interleaved game 128 includes a RC.OS 102, a GW.OS 112, and an EG 120. The RC.OS 102 is connected with the GW.OS 112. The EG 120 is also connected with the GW.OS 112.

In several embodiments, the RC.OS 102 is the operating system for one or more gambling games provided by the sports event driven skill wagering interleaved game 128 and controls and operates the gambling games. The operation of a gambling game is enabled by RC such as money or other real world funds. A gambling game can increase or decrease an amount of RC based on random gambling game outcomes, where the gambling proposition of a gambling game is typically regulated by gaming control bodies. In many embodiments, the RC.OS 120 includes a, pseudo random or random number generator (P/RNG) 106; one or more real-world credit pay tables 108; RC meters 110; and other software constructs that enable a game of chance to offer a fair and transparent gambling proposition, and the auditable systems and functions that can enable the game to obtain gaming regulatory body approval.

P/RNG 106 includes software and/or hardware performing processes that can generate random or pseudo random outcomes. The one or more pay tables 108 are tables that can be used in conjunction with P/RNG 106 to determine an amount of real world credits (RC) earned as a function of sports event driven skill wagering interleaved game gameplay and are analogous to the pay tables used in a conventional slot machine. There can be one or more pay tables 108 in the RC.OS 102. The pay tables 108 are used to implement one or more gambling games. The selection of the pay table 108 to use to resolve a gambling event and/or wager can be based on factors including, but not limited to, game progress a player has earned and/or the eligibility of the player for bonus rounds. Real world credits (RC) are credits analogous to slot machine game credits which are entered into a skill wagering interleaved game by the user either in the form of money such as hard currency or electronic funds. RCs can be decremented and/or augmented based on the outcome of the P/RNG 106 according to a pay table 108 independent of player skill. In certain embodiments, an amount of RC can be used as criteria in order to enter higher levels of the sports event driven entertainment game provided by the sports event driven skill wagering interleaved game sports event driven skill wagering interleaved game interleaved game. In accordance with some embodiments, RC can be carried forward to higher game levels or paid out if a cash out is opted for by a player. The amount of RC used to enter a specific level of the game level n need not be the same for each level.

In many embodiments, the GW.OS 112 manages the overall sports event driven skill wagering interleaved game operation, with the RC.OS 102 and the EG 120 being support units to the GW.OS 112. In several embodiments, the GW.OS 112 may include mechanical, electronic and/or software systems for a sports event driven skill wagering interleaved game entertainment game. The GW.OS 112 provides an interface between sports event driven entertainment game provided by EG 120 and the gambling game provided by RC.OS 102. The GW.OS 112 includes a game world decision engine 122 that receives game world information 124 from the EG 120. The game world decision engine 122 uses the game world information 124, along with trigger logic 126 to generate gambling and/or wagering information 129 about triggering a gambling event and/or an associated wager of RC in the RC.OS 102. In some embodiments, the game world information 124 includes, but is not limited to, game world variables from the EG that indicate the state of the EG and the sports event driven entertainment game that is being played by a player 140; and player actions and interactions 142 between the player and entertainment game provided by the EG 120. The gambling and/or wager information 129 may include, but is not limited to, an amount of RC to be wagered, a trigger of a gambling game, and a selection of a paytable 108 to be used by the gambling game.

In some embodiments, the game world decision engine 122 also receives gambling game outcome information 130 from the RC.OS 102. The decision engine 122 uses the gambling game outcome information 130, in conjunction with the game world information 124 and game world logic 132 to generate game world update information 134 about what kind of game world resources 136 are to be provided to the EG 120. A game world resource generator 138 generates the game world resources 136 based on the game world update information 134 provided by the game world decision engine 122 and transmits the generated resources to the EG 120.

In various embodiments, the game world decision engine 122 also calculates the amount of GWC to award to the player 140 based at least in part on the player's skillful execution of the sports event driven entertainment game of the sports event driven skill wagering interleaved game as determined from the game world information 124. In some embodiments, gambling game outcome information 130 may also be used to determine the amount of GWC should be awarded to the player.

In some embodiments, the game world update information 134 and gambling game outcome information 130 are provided to a player interface generator 144. The player interface generator 144 receives the game world update information 134 and gambling game outcome information 130; and generates sports event driven skill wagering interleaved game information 146 describing the state of the sports event driven skill wagering interleaved game. In some embodiments, the sports event driven skill wagering interleaved game information 146 may include, but is not limited to, amounts of GWC amounts earned, lost or accumulated by the player through skillful execution of the sports event driven entertainment game; and RC amounts won, lost or accumulated as determined from the gambling game outcome information 130 and the RC meters 110. The The GW.OS 112 can further couple to the RC.OS 102 to determine the amount of RC available in the game and other wagering metrics of the gambling game. Thus, the GW.OS 112 may potentially affect the amount of RC in play for participation in the gambling events of a gambling game provided by the RC.OS 102 in some embodiments. The GW.OS 112 may additionally include various audit logs and activity meters. In some embodiments, the GW.OS 112 can also couple to a centralized server for exchanging various data related to the player and the activities of the player during game play of a sports event driven skill wagering interleaved game.

In some embodiments, the GW.OS 112 couples to the EG 120 to manage the sports event driven entertainment game provided. In several embodiments, game world credits (GWC) are player points earned or depleted as a function of player skill as a function of player performance in the context of the game. GWC may be analogous to the score in a typical video game. A sports event driven skill wagering interleaved game entertainment game can have one or more scoring criteria, embedded within the GW.OS 112 and/or the EG 120 that reflect player performance against the goal(s) of the sports event driven game entertainment game. In some embodiments, GWC can be carried forward from one level of sponsored gameplay of the entertainment to another level. In many embodiments, GWC can be used within the EG to purchase in-game items, including but not limited to, elements that have particular properties, power ups for existing items, and other item enhancements. In many embodiments, GWC may be used to earn entrance into a sweepstakes drawing; to earn entrance in a tournament with prizes; to score in the tournament; and/or to participate and/or score in any other game event. In many embodiments, GWC can be stored on a player tracking card or in a network-based player tracking system where the GWC is attributed to a specific player.

In some embodiments, the operation of the GW.OS 112 does not affect the provision of the gambling game by the RC.OS 102 except for player choice parameters that are allowable in a gambling game. Examples of player choice parameters include, but not limited to, wager terms such as but not limited to a wager amount; speed of game play (for example, the pressing a button or pulling the handle of a slot machine); and/or agreement to wager into a bonus round. In accordance with these embodiments, the RC.OS 102 provides a fair and transparent, non-skill based gambling proposition co-processor to the GW.OS 112. In the illustrated embodiment, the transfer of gambling game outcome information 130 shown between the GW.OS 112 and the RC.OS 102 allows the GW.OS 112 to obtain information from the RC.OS 102 as to the amount of RC available in the gambling game. In various embodiments, the communication link can also be used to convey a status operation of the RC.OS 102 (such as on-line or tilt). In a number of embodiments, the communication link used to provide the gambling and/or wagering information 129 between the RC.OS 102 and the GW.OS 112 can further be used to communicate the various gambling control factors which the RC.OS 102 uses as input. Examples of gambling control factors include, but are not limited to, the number of RC consumed per gambling event; and/or the player's election to enter a jackpot round. In FIG. 1, the GW.OS 112 is also shown as connecting to the player's player interface 148 directly, as the GW.OS 112 can utilize the player interface 148 to communicate certain sports event driven entertainment game information including but not limited to, club points; player status; control of the selection of choices; and messages which a player can find useful in order to adjust the sports event entertainment game experience or understand the gambling status of the player in the gambling game in the RC.OS 102.

In various embodiments, the EG 120 manages and controls the visual, audio, and player control for the sports event driven entertainment game. In certain embodiments, the EG 120 accepts input from a player through a set of hand controls, and/or head, gesture, and/or eye tracking systems and outputs video, audio and/or other sensory output to a player interface. In many embodiments, the EG 120 can exchange data with and accept control information from the GW.OS 112. In several embodiments, the EG 120 can be implemented using a processing device executing a specific entertainment game software program. Examples of processing devices that may implement the EG 120 include, but are not limited to, a casino gaming device such as a cabinet based casino game, a personal computer (PC), a Sony PlayStation® (a video game console developed by Sony Computer Entertainment of Tokyo Japan), and a Microsoft Xbox® (a video game console developed by Microsoft Corporation of Redmond, Wash.). In numerous embodiments, the EG 120 can be an electromechanical game system that provides an electromechanical skill wagering interleaved game. An electromechanical skill wagering interleaved game executes an electromechanical entertainment game for player entertainment. The electromechanical entertainment game can be any game that utilizes both mechanical and electrical components, where the game operates as a combination of mechanical motions performed by at least one player or the electromechanical game itself. Various electromechanical skill wagering interleaved games are discussed in Patent Cooperation Treaty Application No. PCT/US12/58156, filed Sep. 29, 2012, now U.S. Pat. No. 8,790,170, issued Jul. 29, 2014, U.S. Pat. No. 8,944,899, issued Feb. 3, 2015, and US Patent Application Publication No. 2015/0141128 A1, the contents of which are hereby incorporated by reference in their entirety.

In the shown embodiment, the EG 120 operates mostly independently from the GW.OS 112. Via the transfer of game world resources 136, however, the GW.OS 112 can send certain sports event driven entertainment game resources including control parameters to the EG 120 to affect the EG's execution, such as (but not limited to) changing the difficulty level of the game. In various embodiments, these sports event driven entertainment game control parameters can be based on a gambling outcome of a gambling game that was triggered by an element in the sports event driven entertainment game being acted upon by the player. The EG 120 can accept this input from the GW.OS 112, make adjustments, and continue sports event driven entertainment game gameplay all the while running seamlessly from the player's perspective.

The execution of the sports event driven entertainment game by the EG 120 is mostly skill based, except for where the processes performed by the EG 120 can inject complexities into the game by chance in the normal operation of gameplay to create unpredictability in the sports event driven entertainment game. The EG 120 can also communicate player choices made in the game to the GW.OS 112, included in the game world information 124, such as but not limited to the player's utilization of the elements of the sports event driven entertainment game during the player's skillful execution of the sports event driven entertainment game. In this architecture, the GW.OS is interfaced to the EG 120 in order to allow the transparent coupling of a sports event driven entertainment game to a fair and transparent random chance gambling game, providing a seamless perspective to the player that they are playing a typical popular sports event driven entertainment game (which is skill based).

In several embodiments, the RC.OS 102 can accept a trigger to resolve a gambling event in a gambling game in response to actions taken by the player in the sports event driven entertainment game as conveyed by the EG 120 to the GW.OS 112. The GW.OS 112 triggers the gambling event in the gambling game using trigger logic 126, and the RC.OS 102 resolves the gambling event in the background of the overall sports event driven skill wagering interleaved game from the player's perspective and provide information about the outcome of the gambling event to the GW.OS 112 to expose the player to certain aspects of the gambling game. Examples of aspects of the gambling game that may be exposed to the player include, but are not limited to, odds of certain outcomes, amount of RC in play, and amount of RC available. In a number of embodiments, the RC.OS 102 can accept modifications in the amount of RC wagered on each individual gambling event, in the number of gambling events per minute the RC.OS 102 can resolve entrance into a bonus round, and other factors. One skilled in the art will note that these factors can take a different form than that of a typical slot machine. An example of a varying wager amount that the player can choose can include, but is not limited to, gameplay using a more difficult sports event driven entertainment game level. These factors can increase or decrease the amount wagered per individual gambling game in the same manner that a standard slot machine player can decide to wager more or less credits for each pull of the handle. In several embodiments, the RC.OS 102 can communicate a number of factors back and forth to the GW.OS 112, via an interface, such that an increase/decrease in a wagered amount can be related to the change in player profile of the player in the sports event driven entertainment game. In this manner, a player can control a wager amount per gambling event in the gambling game with the change mapping to a parameter or component that is applicable to the sports event driven entertainment game experience.

In many embodiments, a sports event driven skill wagering interleaved game integrates a video game style gambling game provided by a gambling machine where the gambling game (including an RC.OS 102 and RC) may not be player skill based. In some embodiments, the gambling game may allow players to use their skills to earn club points which a casino operator can translate into rewards including, but not limited to, tournament opportunities and prizes for the players. The actual exchange of monetary funds earned or lost directly from gambling against a game of chance in a gambling game, such as a slot machine, is preserved. At the same time, a rich environment of rewards to stimulate gamers can be established within the sports event driven entertainment game. In several embodiments, the sports event driven skill wagering interleaved game can leverage entertainment game titles popular with gamers and provide a sea change in a casino environment to attract players with games that are more akin to the type of entertainment that a younger generation desires. In various embodiments, players can use their skill in the sports event driven entertainment game towards building and banking GWC. The GWC may then by be used to win tournaments and various prizes as a function of skills of the gamer. In a number of embodiments, the sports event driven skill wagering interleaved game minimizes the underlying changes applied to the aforementioned entertainment software for the skill wagering interleaved game to operate within a sports event driven entertainment game construct. Therefore, a plethora of complex game titles and environments can be rapidly and may be inexpensively deployed in a gambling environment.

In certain embodiments, sports event driven skill wagering interleaved games also allow players to gain entry into subsequent competitions through the accumulation of game world credits (GWC) as a function of the user's demonstrated skill at the game. These competitions can pit individual players or groups of players against one another and/or against the operator of a gambling game (such as but not limited to a casino) to win prizes based upon a combination of chance and skill. These competitions can be asynchronous events whereby players participate at a time and/or place of their choosing or synchronized events whereby players participate at a specific time and/or venue.

In many embodiments, one or more players can be engaged in playing a skill based sports event driven entertainment game executed by the EG 120. In various embodiments, a sports event driven skill wagering interleaved game can include a sports event driven entertainment game that includes head to head play between a single player and the computer; between two or more players against one another; or multiple players playing against the computer and/or each other as well as a process by which a player can bet on the outcome of a sports event driven entertainment game. In some embodiments, the sports event driven entertainment game can be a game where the player is not playing against the computer or any other player such as games where the player is effectively playing against himself or herself.

Figure 2:
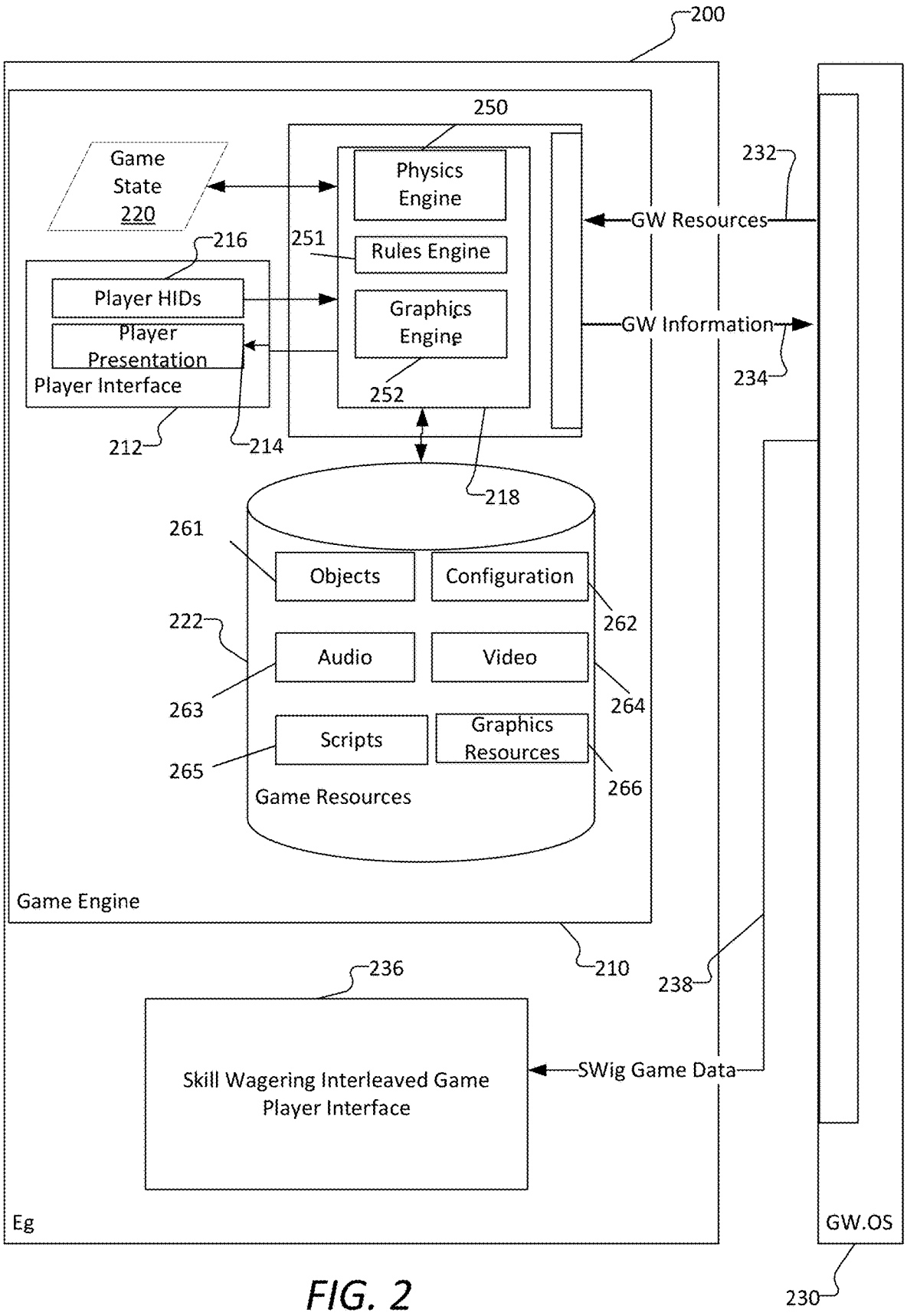
FIG. 2 illustrates a block diagram of components of a sports event driven entertainment game in accordance with an embodiment of the invention.

The components of an EG in accordance with an embodiment of the invention are shown in FIG. 2. The EG 200 may be part of the sports event driven entertainment game system itself, may be a software module that is executed by the sports event driven entertainment game system, or may provide an execution environment for the sports event driven entertainment game on a particular host entertainment game system. The EG 200 and an associated sports event driven entertainment game are hosted by an EG device. The EG device is a computing device that is capable of hosting the EG. Embodiments of devices include, but are not limited to, electronic gaming machines, video game consoles, smart phones, personal computers, tablet computers, or the like. In several embodiments, an EG 200 of a sports event driven skill wagering interleaved game includes a game engine 210 that generates a player interface 212 for interaction with a player. The player interface includes a player presentation 214 that is presented to a player through the player interface. The player presentation may include audio features, visual features or tactile feature, or any combination of these preceding features. The player interface 212 further includes one or more human input devices (HIDs) 216 that the player can use to interact with the sports event driven skill wagering interleaved game. Various components or sub-engines 218 of the game engine can read data from a game state 220 in order to implement the features of the EG. In some embodiments, components or sub-engines 218 of the game engine 210 can include, but are not limited to, a physics engine 250, a rules engine 251, and/or a graphics engine 252. The physics engine 250 is used to simulate physical interactions between virtual objects in the game state. The rules engine 251 implements the rules of the sports event driven entertainment game and an RNG that may be used for influencing or determining certain variables and/or outcomes to provide a randomizing influence on game play. The graphics engine 252 is used to generate a visual representation of the game state to the player. Furthermore, the sub-engines 218 may also include an audio engine (Not Shown) to generate audio outputs for the player interface 214.

During operation, the game engine 210 reads and writes game resources 222 stored on a data store of the EG host. The game resources 222 may include game objects 261 having graphics and/or control logic used to implement game world objects of the sports event driven entertainment game. In various embodiments, the game resources may also include, but are not limited to, video files 264 that are used to generate cut-scenes for the sports event driven entertainment game; audio files 263 used to generate music, sound effects, etc. within the sports event driven entertainment game; configuration files 262 used to configure the features of the sports event driven entertainment game; scripts or other types of control code 265 used to implement various game play features of the sports event driven entertainment game; and graphics resources 266 such as textures, objects, etc. that are used by the game engine to render objects displayed in a sports event driven entertainment game.

In operation, components of the game engine 210 read portions of the game state 220 and generate the player presentation 214 for the player which is presented to the player using the player interface 212. The player perceives the presentation and provides player inputs using the HIDs 216. The corresponding player inputs are received as player actions or inputs by various components of the game engine 210. The game engine 210 translates the player actions into interactions with the virtual objects of the game world stored in the game state 220. Components of the game engine use the player interactions with the virtual objects of the sports event driven entertainment game and the sports event driven entertainment game state 220 to update the game state 220 and update the presentation 214 presented to the user. The process loops in a game loop continuously while the player plays the sports event driven skill wagering interleaved game.

The EG 200 provides one or more interfaces between an EG 200 and other components of a sports event driven skill wagering interleaved game, such as a GW.OS 230. The EG 200 and the other sports event driven skill wagering interleaved game components communicate with each other using the interfaces. The interface may be used to pass various types of data; and to send and receive messages, status information, commands and the like. In certain embodiments, the EG 200 and GW.OS 230 exchange game world resources 232 and game world information 234. In some embodiments, the communications include requests by the GW.OS 230 that the EG 200 update the game state 220 using information provided by the GW.OS 230. In many embodiments, a communication by the GW.OS 230 requests that the EG 200 update one or more game resources 222 using information provided by the GW.OS 230. In a number of embodiments, the EG 200 provides all or a portion of the game state to GW.OS 230. Is some embodiments, the EG 200 may also provide information about one or more of the game resources 222 to the GW.OS 230. In some embodiments, the communication includes player actions that the EG 200 communicates to the GW.OS 230. The player actions may be low level player interactions with the player interface 212, such as manipulation of an HID, or may be high level interactions with game objects as determined by the sports event driven entertainment game. The player actions may also include resultant actions such as modifications to the sports event driven skill wagering interleaved gamestate 220 or game resources 222 resulting from the player's actions taken in the sports event driven skill wagering interleaved entertainment game. In some embodiments, player actions include, but are not limited to, actions taken by entities such as non-payer characters (NPC) of the sports event driven entertainment game that act on behalf of or under the control of the player.

In some embodiments, the EG 200 includes a sports event driven skill wagering interleaved game player interface 236 used to communicate sports event driven skill wagering interleaved game data 238 to and from the player. The communications from sports event driven skill wagering interleaved game interface 236 include, but are not limited to, information used by the player to configure gambling game RC wagers, and information about the gambling game RC wagers such as, but not limited to, RC balances and RC amounts wagered.

Figure 3:
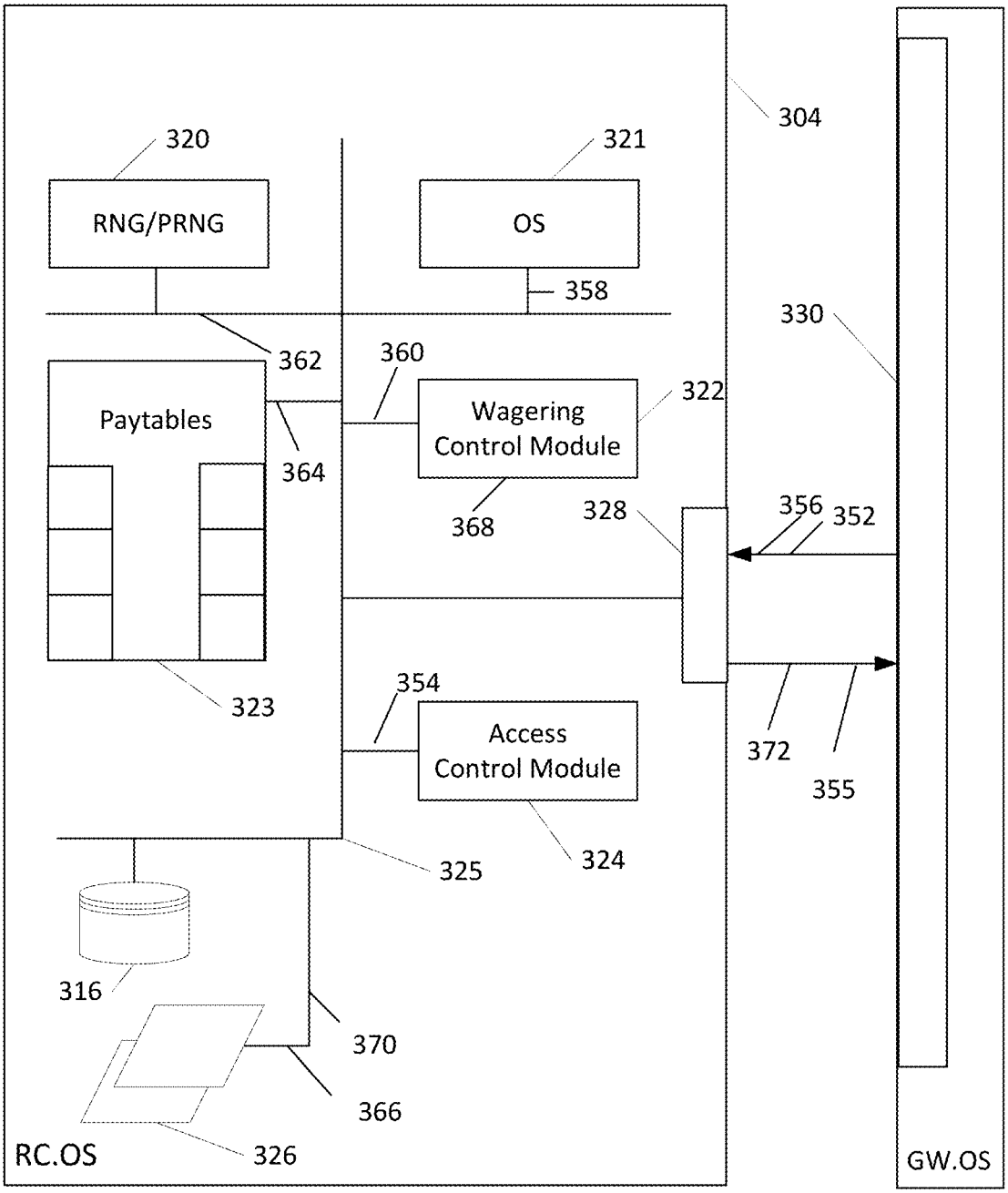
FIG. 3 illustrates a block diagram of components of a real credit operating system in accordance with an embodiment of the invention.

Components of an RC.OS in accordance with an embodiment of the invention are shown in FIG. 3. The RC.OS 304 has an operating system OS 321 which controls the functions of the RC.OS 304; a random number generator (RNG) 320 to produce random numbers or pseudo random numbers; one or more pay tables 323 which includes a plurality of factors indexed by the random number to be multiplied with an amount of RC committed in a wager; and a wagering control module 322 whose processes may include, but are not limited to, pulling random numbers, looking up factors in the pay tables, multiplying the factors by an amount of RC wagered, and administering one or more RC credit meters 326. The RC.OS 304 may also include storage for statuses, wagers, wager outcomes, meters and other historical events in a storage device 316. An authorization access module 324 provides a process to permit access and command exchange with the RC.OS 304 and access to a repository (a credit meter) 326 for the amount of RC which player has deposited in the sports event driven skill wagering interleaved game. An external interface 328 allows the RC.OS 304 to interface to another system or device, such as a GW.OS 330. The various RC.OS modules and components can interface with each other via an internal bus 325 and/or other appropriate communication mechanism.

In various embodiments, an RC.OS 304 may use an RNG provided by an external system. The external system may be connected to the RC.OS 304 by a local area network (LAN) or a wide area network (WAN) such as the Internet. In some embodiments, the external RNG is a central deterministic system such as a regulated and controlled random numbered ball selection device or some other system that provides random or pseudo random numbers to one or more connected RC.OSs. In numerous embodiments, the interface between the RC.OS 304 and other systems/devices including an external RNG may be the Internet. However, other methods of communication may be used including, but not limited to, a LAN, a USB interface, and/or some other method by which two electronic devices could communicate with each other.

In numerous embodiments, signaling occurs between various components of an RC.OS 304 and an external system, such as GW.OS 330. In some of these embodiments, the purpose of the RC.OS 304 is to manage wagering on gambling events and to provide random (or pseudo random) numbers from an RNG. The external system requesting wagering support instructs the RC.OS 304 as to the pay table 328 to use and/or the amount of RC to wager. Next, the external system signals the RC.OS 304 to trigger a gambling event with an associated wager on the results of the gambling event wager. The RC.OS 304 resolves the gambling event and determines the outcomes of the wager. The RC.OS can then inform the external system as to the outcome of the wager (the amount of RC won) and/or the amount of RC in the player's account in the credit repository.

In various embodiments, a second communication exchange between the RC.OS 304 and an external system relates to the external system using an RNG result support from the RC.OS 304. In this exchange, the external system requests an RNG result from the RC.OS 304. In response, the RC.OS 304 returns an RNG result as a function of an internal RNG or an RNG external to the RC.OS 304 to which the RC.OS 304 is connected.

In some embodiments, a communication exchange between the RC.OS 304 and an external system relate to the external system support for coupling an RNG result to a particular pay table contained in the RC.OS 304. In such an exchange, the external system instructs the RC.OS 304 as to the pay table 323 to use, and requests a result whereby the RNG result would be coupled to the requested pay table 323. The result of the coupling is returned to the external system.

In such an exchange, no actual RC wager is conducted, but might be useful in coupling certain non-RC wagering sports event driven entertainment game behaviors and propositions to the same final resultant wagering return which is understood for the sports event driven skill wagering interleaved game to conduct wagering. In a number of embodiments, some or all of the various commands and responses discussed above can be combined into one or more communication packets.

The RC.OS 304 operates in the following manner in accordance with some embodiments of the invention. The process begins by a RC.OS 304 receiving signals from an external system requesting a connection to RC.OS 304 (352). The request includes credentials for the external system. The Access Authorization Module 324 determines that the external system is authorized to connect to RC.OS 304 (354) and transmits an authorization response to the external system (355). The external systems provide a request for a gambling event to be performed to the RC.OS 304 (356). The request may include an indication of a wager amount on a proposition in the gambling event, and a proper pay table 323 to use to resolve the wager. The external system then sends a signal to trigger the gambling event (358).

The OS 321 instructs the Wager Control Module 322 as to the amount of the RC wager and the Pay Table 323 to select as well as to resolve the wager (360). In response to the request to execute the gambling event, the wager control module 322 requests an P/RNG result from the P/RNG 320 (362); retrieves a proper pay table or tables from the pay tables 323 (364); adjusts the RC of the player in the RC repository 326 as instructed (366); applies the P/RNG result to the particular pay table or tables 323 (368); and multiplies the resultant factor from the Pay Table by the amount of RC wagered to determine the result of the wager (368). Wager Control Module 322 then adds the amount of RC won by the wager to the RC repository 326 (370); and provides the outcome of the wager, and the amount of RC in the repository and the RC won to the external system (372). It should be understood that there may be many different embodiments of an RC.OS 304 including embodiments where many modules and components of the RC.OS 304 are located in various servers and locations, so the foregoing is not meant to be exhaustive or all inclusive, but rather provide information on various embodiments of an RC.OS 304.

Figure 4:
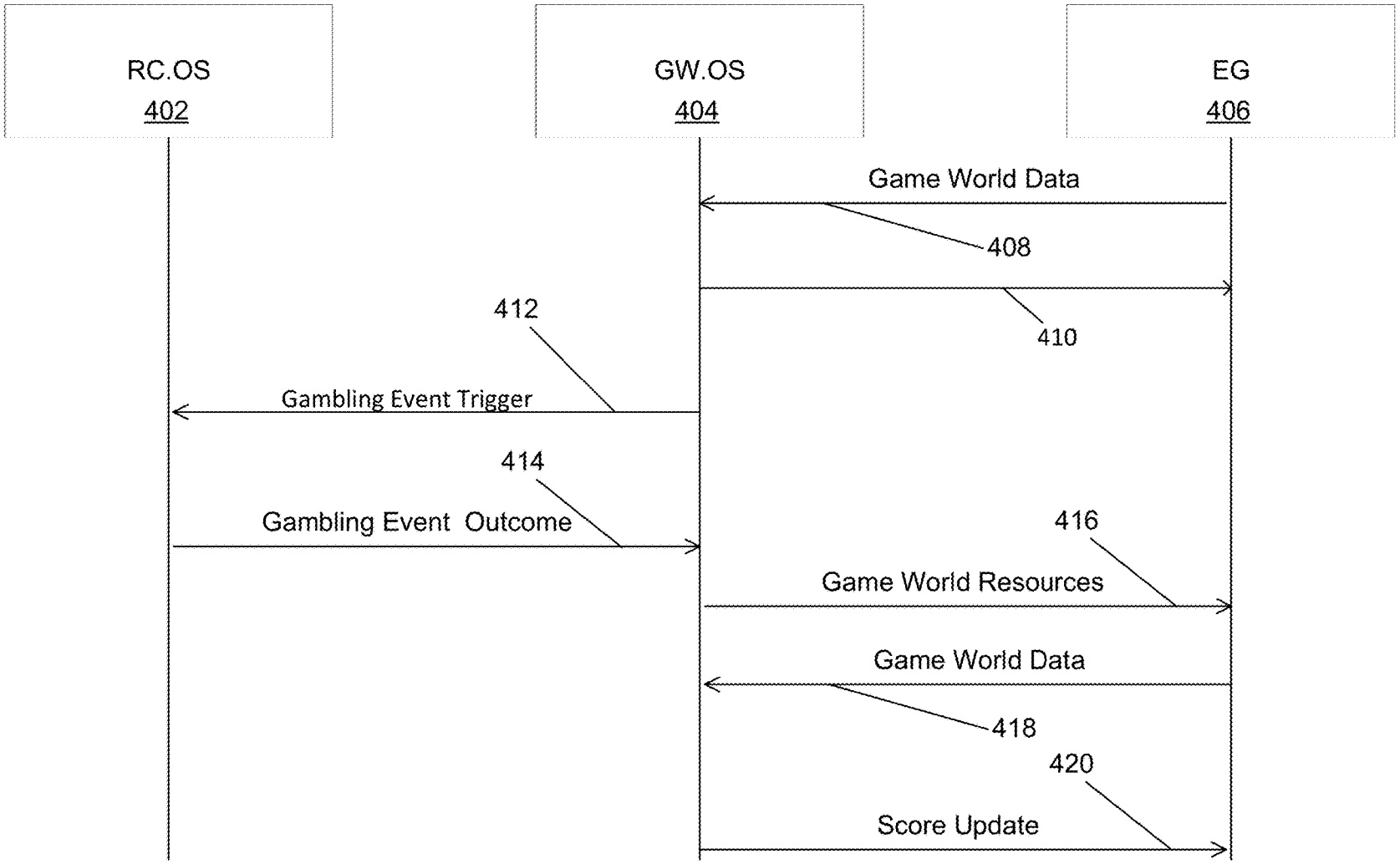
FIG. 4 illustrates a timing diagram of interactions between components of a sports event driven skill wagering interleaved game entertainment game in accordance with an embodiment of the invention.

A timing diagram of a process that facilitates interactions between components of a sports event driven skill wagering interleaved game providing a sports event driven entertainment game and a gambling game in accordance with an embodiment of the invention is shown in FIG. 4. The components of the sports event driven skill wagering interleaved game process include RC.OS 402, GW.OS 404, and EG 406. The process begins with EG 406 detecting a player performing a player action in the sports event driven entertainment game using a player interface. The EG 406 provides a GW.OS 404 with game world data (408). In some embodiments, the game world data includes but is not limited to, the player interaction detected by the EG 406. In some embodiments, the GW.OS 404 can provide the EG 406 with information as to the amount of EE that will be consumed by the player action in response to receiving the game world data (410). The GW.OS 404 may also provide information to configure a function that controls EE consumption, decay or addition to the EG 406 in response to receiving the game world data. The EG 406 can, based upon the function, consume an amount of EE designated by the GW.OS 404 to couple to the player action. Upon detection that the player action is a gameplay gambling event, the GW.OS 404 can send a request to provide a gambling event to an RC.OS 402 (412). The request for a gambling event may include the wager terms associated with the gameplay gambling event in some embodiments. The RC.OS 402 can consume RC in executing the gambling event and resolving the wager. The RC.OS 402 can return RC as a payout from the wager. The RC.OS 402 can inform (414) the GW.OS 404 as to the outcome of the gambling event and/or any associated wagers. Based on the outcome of the gambling event, the GW.OS 404 can determine game world resources in the sports event driven entertainment game to award to the player. The GW.OS may provide information about the game world resources award to the EG 406 (416). In some embodiments, the game world resources may be a payout of EE based upon the outcome of the gambling event and/or a wager associated with the gambling event. The EG 406 can reconcile and combine the payout of EE with the EE already ascribed to the player in the sports event driven skill entertainment game. In various embodiments, the EG 406 can provide an update to the GW.OS 404 as to the updated status of the sports event driven entertainment game based upon reconciling the payout of EE. The GW.OS 404 may then determine an amount of GWC to award in the sports event driven entertainment game based upon the updated status and provide the GWC amount to the EG 406 in response to the status update in some embodiments.

The following is an example of the sequence of events in the timing diagram of FIG. 4 in a sports event driven skill wagering interleaved game provides a Sudoku game as the sports event driven entertainment game in accordance with an embodiment of the invention. In a Sudoku game, a player can take an action, such as selecting a number to be placed in a section of a Sudoku board. The EG 406 provides information about the player action to the GW.OS 404 (408). The information about the player action may include, but is not limited to, the player's choice of a symbol, the position on the Sudoku puzzle board that the symbol is played, and whether or not the symbol as played was a correct symbol in terms of eventually solving the Sudoku puzzle. The GW.OS 404 can process the information concerning the placement of the symbol, and determine that the player action consumes a symbol (EE) with each placement. The GW.OS 404 provides information about the consumption of the symbol to the EG 406 (410). The EG 406 then will consume the EE based upon the placement of the symbol. The GW.OS can also determine that a gambling event is triggered by the placement of the symbol and transmit a request (412) to the RC.OS 402. The request may indicate that 3 credits of RC are to be wagered on the outcome of the gambling event to match the placement of the symbol (EE) that is consumed and indicate a particular pay table (table Ln-RC) that the RC.OS 402 is to use to resolve the wager. The RC.OS 402 can consume the 3 credits for the wager, execute gambling event, and resolve the specified wager. In executing the gambling event and resolving the wager, the RC.OS 402 can determine that the player hits a jackpot of 6 credits and allocate the 6 credits of RC to the credit meter. In other embodiments, any of a variety of credits, pay tables and/or payouts can be utilized in the resolution of gambling events as appropriate to the requirements of specific applications. The RC.OS 402 also provides gambling event outcome information to the GW.OS 404 (414) that informs the GW.OS 404 that 6 credits of RC net were won as a payout from the wager. Based on the gambling event outcome information, the GW.OS 404 can determine that 2 additional symbols are to be made available to the player.

The GW.OS 404 provides the game world resources information (416) to the EG 406 informing the EG 406 to add 2 additional symbols (EE) to the set of symbols available to a player based upon the gambling game payout. The EG 406 can then add 2 symbols (EE) to the number of symbol placements available to a player in the Sudoku game. The GW.OS can receive an update (418) from the EG 406 as to the total amount of EE associated with the player. The GW.OS can log the new player score (GWC) in the game (as a function of the successful placement of the symbol) based on the update, and provide a score update (420) the EG to add 2 extra points of GWC to the player's score. Although the above discussion describes the performance of the processes shown in FIG. 4 in the context of a Sodoku entertainment game, similar processes can be utilized to provide other types of entertainment games appropriate to the requirements of specific applications in accordance with embodiments of the invention.

In many embodiments, a player can bet on whether or not the player will beat another player. These bets can be made, for example, on the final outcome of a sports event driven entertainment game, and/or the state of the sports event driven entertainment game along various intermediary points (such as but not limited to the score at the end of a period of time of a sports event entertainment game session) and/or on various measures associated with the sports event driven entertainment game. Players can bet against one another, or engage the computer in a head to head competition in the context of the player's skill level in the sports event driven entertainment game in question. As such, players can have a handicap associated with their player profile that describes their skill in the sports event driven entertainment game which can be the professed skill of the player in some embodiments. The handicap may be used by a GW.OS to offer appropriate bets around the final and/or intermediate outcomes of the sports event driven entertainment game; to condition sponsored gameplay as a function of player skill; and/or to select players across one or more sports event driven skill wagering interleaved games to participate in head to head games and/or tournaments.

Many embodiments of the sports event driven skill wagering interleaved game enable the maximization of the number of players able to compete competitively by handicapping the players based upon skill in the sports event driven entertainment game and utilizing a skill normalization module to modify the sports event driven entertainment game based upon the handicaps of players to even the skill level of players competing against each other. Handicapping enables players of varying performance potential to compete competitively regardless of absolute skill level, such as, but not limited to, where a player whose skill level identifies the player as a beginner can compete in head to head or tournament play against a highly skilled player with meaningful results.

In several embodiments, wagers can be made among numerous sports event driven skill wagering interleaved games with a global betting manager (GBM). The GBM is a system that coordinates wagers that are made across multiple sports event driven skill wagering interleaved games by multiple players. In some embodiments, the GBM can also support wagers by third parties relative to the in game performance of other players. The GBM can be a stand-alone system; can be embedded in one of a number of systems including the GW.OS, EG, or any remote server capable of providing services to a sports event driven skill wagering interleaved game; or can operate independently on one or a number of servers on-site at a casino, as part of a larger network and/or the Internet or cloud in general.

Although various components of sports event driven skill wagering interleaved games are discussed above, sports event driven skill wagering interleaved games can be configured with any component as appropriate to the specification of a specific application in accordance with embodiments of the invention. In certain embodiments, components of a sports event driven skill wagering interleaved game, such as a GW.OS, RC.OS, and/or EG, can be configured in different ways for a specific sports event driven skill wagering interleaved game gameplay application. Stand-alone and network connected sports event driven skill wagering interleaved games are discussed below.

Stand-Alone Sports Event Driven Skill Wagering Interleaved Games

Figure 5A:
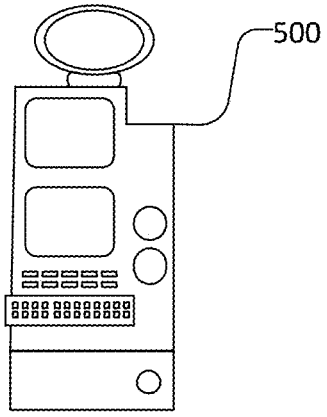
FIGS. 5A, 5B, 5C, and 5D illustrate various devices that host a sports event driven skill wagering interleaved game in accordance with some embodiments of the invention.
Figure 5B:
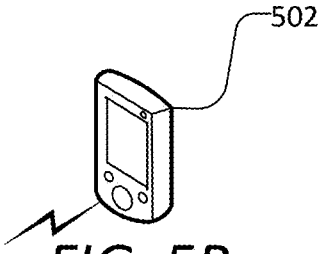
Figure 5C:
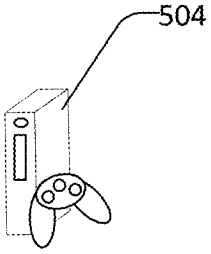
Figure 5D:
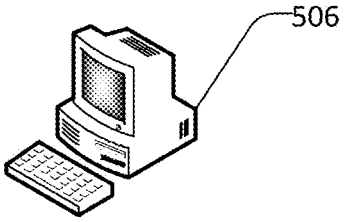

Various types of devices that may be used to host a sports event driven skill wagering interleaved game on a stand-alone device in accordance with various embodiments of the invention are shown in FIGS. 5A to 5D. An electronic gaming machine 500 may be used to host a sports event driven skill wagering interleaved game. The electronic gaming machine 500, shown in FIG. 5A may be physically located in a casino or other gaming establishment. A portable device 502 shown in FIG. 5B is a device that may wirelessly connect to a network and may be used to host a sports event driven skill wagering interleaved game. Examples of portable devices 502 include, but are not limited to, a tablet computer and/or a smartphone. A gaming console 504, shown in FIG. 5C, may also be used to host a sports event driven skill wagering interleaved game. A personal computer 506, shown in FIG. 5D, may also be used to host a sports event driven skill wagering interleaved game in accordance with several embodiments of the invention. Indeed, any device including sufficient processing and/network communication capabilities can be utilized to host a sports event driven skill wagering interleaved game as appropriate to the requirements of specific applications in accordance with embodiments of the invention.

Network Connected Sports Event Driven Skill Wagering Interleaved Games

Some sports event driven skill wagering interleaved games in accordance with many embodiments of the invention can operate locally while being network connected to draw services from remote locations or to communicate with other sports event driven skill wagering interleaved games. In many embodiments, operations associated with a sports event driven skill wagering interleaved game utilizing a sports event driven entertainment game can be performed across multiple devices. These multiple devices can be implemented using a single server or a plurality of servers such that a sports event driven skill wagering interleaved game is executed as a system in a virtualized space such as, but not limited to, where the RC.OS and GW.OS are large scale centralized servers in the cloud coupled to widely distributed EG controllers or clients via the Internet.

In many embodiments, a RC.OS server can perform certain functionalities of a RC.OS of a sports event driven skill wagering interleaved game. In certain embodiments, a RC.OS server includes a centralized odds engine which can generate random outcomes (such as, but not limited to, win/loss outcomes) for gambling events in a gambling game. The RC.OS server can perform a number of simultaneous or pseudo-simultaneous runs in order to generate random outcomes for a variety of odds percentages that one or more networked sports event driven skill wagering interleaved games can use. In a number of embodiments, an RC.OS of a sports event driven skill wagering interleaved game can send information to a RC.OS server including, but not limited to, paytables, maximum speed of play for a gambling game, gambling game monetary denominations, or any promotional RC provided by the operator of the sports event driven skill wagering interleaved game. In some specific embodiments, a RC.OS server can send information to a RC.OS of a sports event driven skill wagering interleaved game including, but not limited to, RC used in the gambling game, player profile information, play activity, and/or a profile associated with a player.

In several embodiments, a GW.OS server can perform the functionality of the GW.OS across various sports event driven skill wagering interleaved games. These functionalities can include, but are not limited to, providing a method for monitoring high scores on select groups of games, coordinating interactions between gameplay layers, linking groups of games in order to join them in head to head tournaments, and acting as a tournament manager.

In a variety of embodiments, management of player profile information can be performed by a patron management server separate from a GW.OS server. A patron management server can manage information related to a player profile. The managed information in the player profile may include, but is not limited to, data concerning controlled entities (characters) in sports event driven entertainment game gameplay; game scores; game elements; RC and GWC associated with a particular players; and tournament reservations. Although a patron management server is discussed separate from a GW.OS server, a GW.OS server also performs the functions of a patron management server in some embodiments. In a number of embodiments, a GW.OS of a sports event driven skill wagering interleaved game can send information to a patron management server. The information sent by the GW.OS to the patron management system may include, but is not limited to, GWC and RC used in a game; player profile information; play activity; profile information for players; synchronization information between a gambling game and a sports event driven entertainment game; and/or information about other aspects of a sports event driven skill wagering interleaved game. In several embodiments, a patron management server can send patron information to a GW.OS of a sports event driven skill wagering interleaved game. The patron information may include, but is not limited to, sports event driven entertainment game title and type; tournament information; table Ln-GWC tables; special offers; character or profile setup and synchronization information between a gambling game and a sports event driven entertainment game; and information about any other aspect of a sports event driven skill wagering interleaved game.

In numerous embodiments, an EG server provides a host for managing head to head play operating on a network of EGs connected to the EG server via a network such as the Internet. The EG server provides an environment where players can compete directly with one another and interact with other players. Although an EG server is discussed as separate from a GW.OS server, the functionalities of an EG server and GW.OS server can be combined in a single server in some embodiments.

Servers connected via a network to implement sports event driven skill wagering interleaved games in accordance with many embodiments of the invention can communicate with each other to provide services utilized by a sports event driven skill wagering interleaved game. In several embodiments, a RC.OS server can communicate with a GW.OS server. In some embodiments, the RC.OS server can communicate with a GW.OS server to communicate any type of information as appropriate for a specific application. Examples of the information that may be communicated include, but are not limited to, information used to configure the various simultaneous or pseudo simultaneous odds engines executing in parallel within the RC.OS to accomplish sports event driven skill wagering interleaved game system functionalities; information used to determine metrics of RC.OS performance such as random executions run and/or outcomes for tracking system performance; information used to perform audits and/or provide operator reports; and information used to request the results of a random run win/loss result for use in one or more function(s) operating within the GW.OS such as, but not limited to, automatic drawings for prizes that are a function of EG performance.

In several embodiments, a GW.OS server can communicate with an EG server. A GW.OS server can communicate with an EG server to communicate any type of information as appropriate for a specific application. The information that may be communicated between a GW.OS server and an EG server includes, but is not limited to, the information for management of an EG server by a GW.OS server during a sports event driven skill wagering interleaved game tournament. Typically, a GW.OS (such as a GW.OS that runs within a sports event driven skill wagering interleaved game or on a GW.OS server) is not aware of the relationship of the GW.OS to the rest of a tournament since the actual tournament play is managed by the EG server in a typical configuration. Therefore, management of a sports event driven skill wagering interleaved game tournament can include, but is not limited to tasks including, but not limited to, conducting tournaments according to system programming that can be coordinated by an operator of the sports event driven skill wagering interleaved game; allowing entry of a particular player into a tournament; communicating the number of players in a tournament; and the status of the tournament (such as, but not limited to the amount of surviving players, the status of each surviving player within the game, and time remaining on the tournament); communicating the performance of players within the tournament; communicating the scores of the various players in the tournament; and providing a synchronizing link to connect the GW.OSs in a tournament with their respective EGs.

In several embodiments, a GW.OS server can communicate with a patron management server. A GW.OS server can communicate with a patron management server to communicate any type of information as appropriate for a specific application. Examples of information communicated between a GW.OS server and a patron management system include, but are not limited to, information for configuring tournaments according to system programming conducted by an operator of a sports event driven skill wagering interleaved game; information for exchange of data used to link a player's player profile to an ability to participate in various forms of sports event driven skill wagering interleaved game gameplay (such as but not limited to the difficulty of play set by the GW.OS server or the GW.OS); information for determining a player's ability to participate in a tournament as a function of a player's characteristics (such as but not limited to a player's gaming prowess or other metrics used for tournament screening); information for configuring GW.OS and EG performance to suit preferences of a player on a particular sports event driven skill wagering interleaved game; and information for determining a player's play and gambling performance for the purposes of marketing intelligence; and information for logging secondary drawing awards, tournament prizes, RC and/or GWC into the player profile.

In many embodiments, the actual location of where various process are executed can be located either in the game contained devices (RC.OS, GW.OS, EG), on the servers (RC.OS server, GW.OS server, or EG server), or a combination of both game contained devices and servers. In a number of embodiments, certain functions of a RC.OS server, GW.OS server, patron management server and/or EG server can operate on the local RC.OS, GW.OS and/or EG contained with a sports event driven skill wagering interleaved game being provided locally on a device. In some embodiments, a server can be part of a server system including multiple servers, where software can be run on one or more physical devices. Similarly, in particular embodiments, multiple servers can be combined on a single physical device.

Figure 6A:
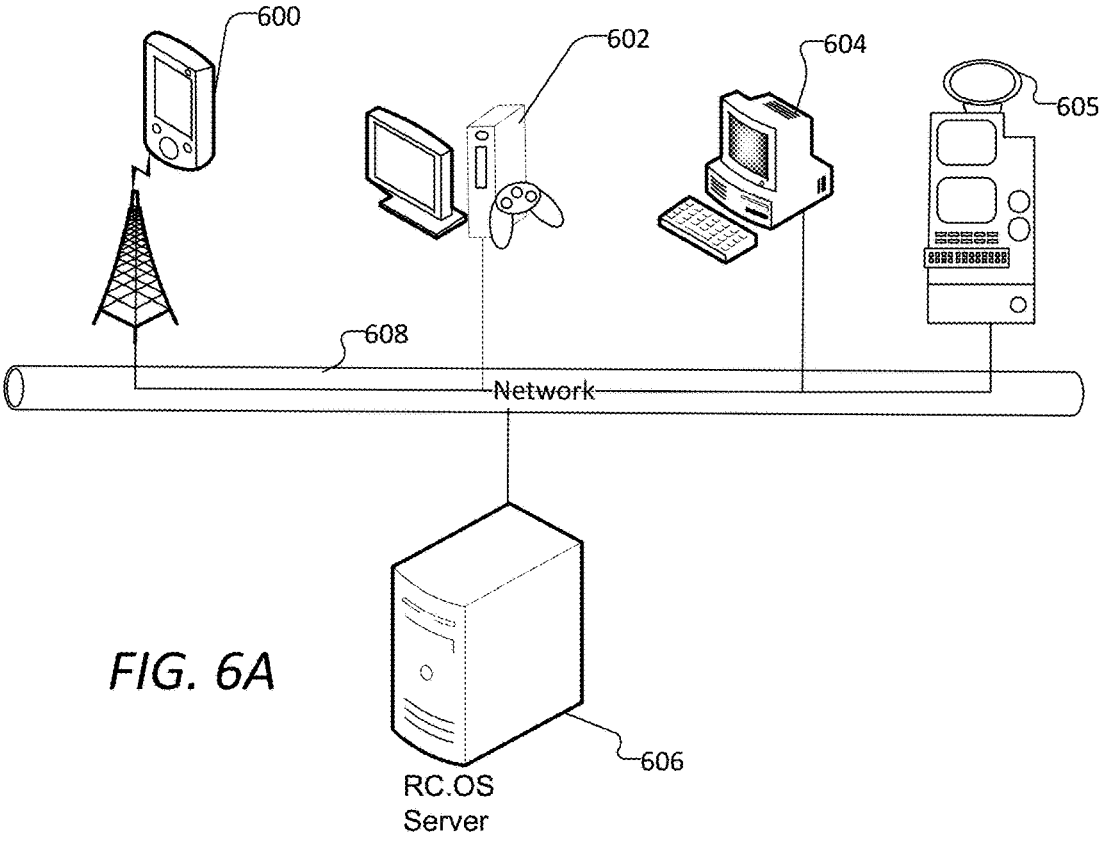
FIGS. 6A, 6B and 6C illustrate embodiments of a distributed sports event driven skill wagering interleaved game in accordance with different embodiments of the invention.

Some sports event driven skill wagering interleaved games in accordance with many embodiments of the invention can be networked with remote servers in various configurations. A networked sports event driven skill wagering interleaved game in accordance with an embodiment of the invention is illustrated in FIG. 6A. As illustrated, one or more end devices of networked sports event driven skill wagering interleaved games such as a mobile device 600, a gaming console 602, a personal computer 604, and an electronic gaming machine 605 are connected with a RC.OS server 606 over a network 608. Network 608 is a communications network that allows processing systems to share data. Examples of the network 608 can include, but are not limited to, a Local Area Network (LAN) and a Wide Area Network (WAN). In some embodiments, the processes of an EG and a GW.OS as described herein are executed on the individual end devices 600, 602, 604 and 605 while the processes of the RC.OS as described herein can be executed by the RC.OS server 606.

Figure 6B:
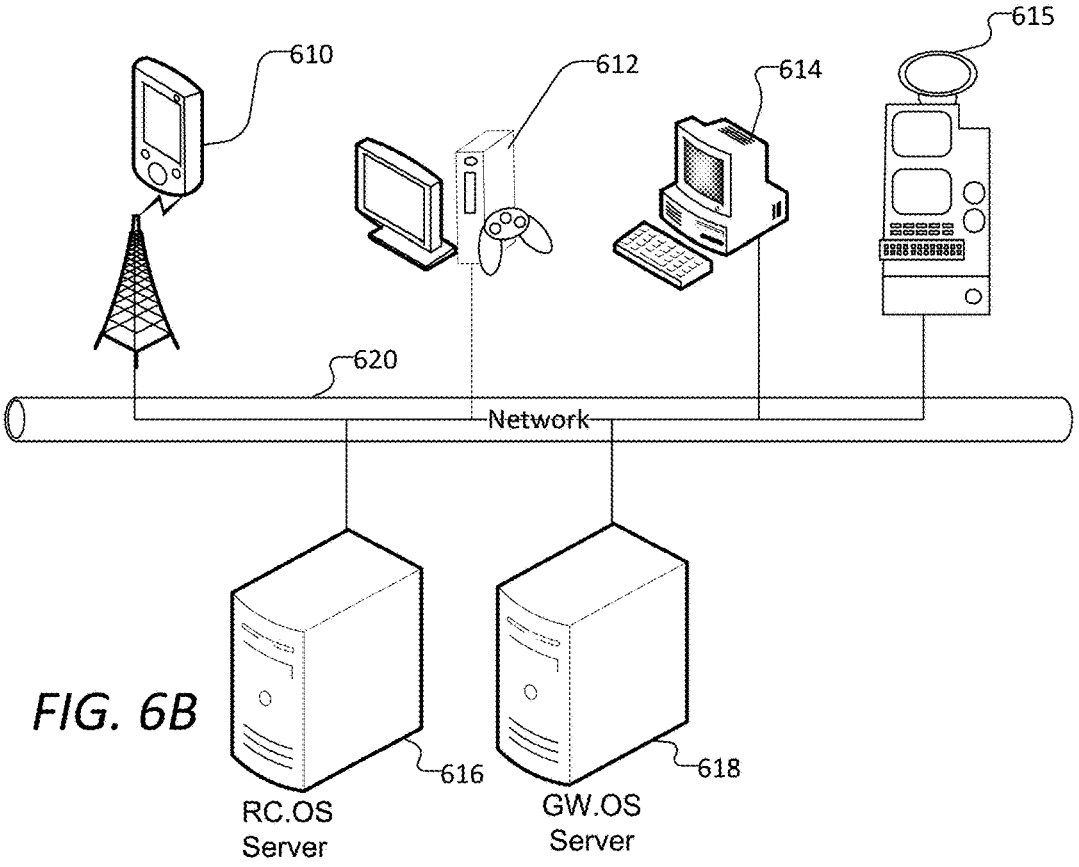

A networked sports event driven skill wagering interleaved game in accordance with another embodiment of the invention is illustrated in FIG. 6B. As illustrated, one or more end devices of networked sports event driven skill wagering interleaved games, such as a mobile device 610, a gaming console 612, a personal computer 614, and an electronic gaming machine 615, are connected with an RC.OS server 616 and a GW.OS server 618 over a network 620. Network 620 is a communications network that allows processing systems to share data. Examples of the network 620 can include, but are not limited to, a Local Area Network (LAN) and a Wide Area Network (WAN). In some embodiments, the processes of an EG as described herein are executed on the individual end devices 610, 612, 614 and 615. The processes of the RC.OS as described herein are executed by the RC.OS server 616 and the processes of the GW.OS as described herein are executed by the GW.OS server 618.

Figure 6C:
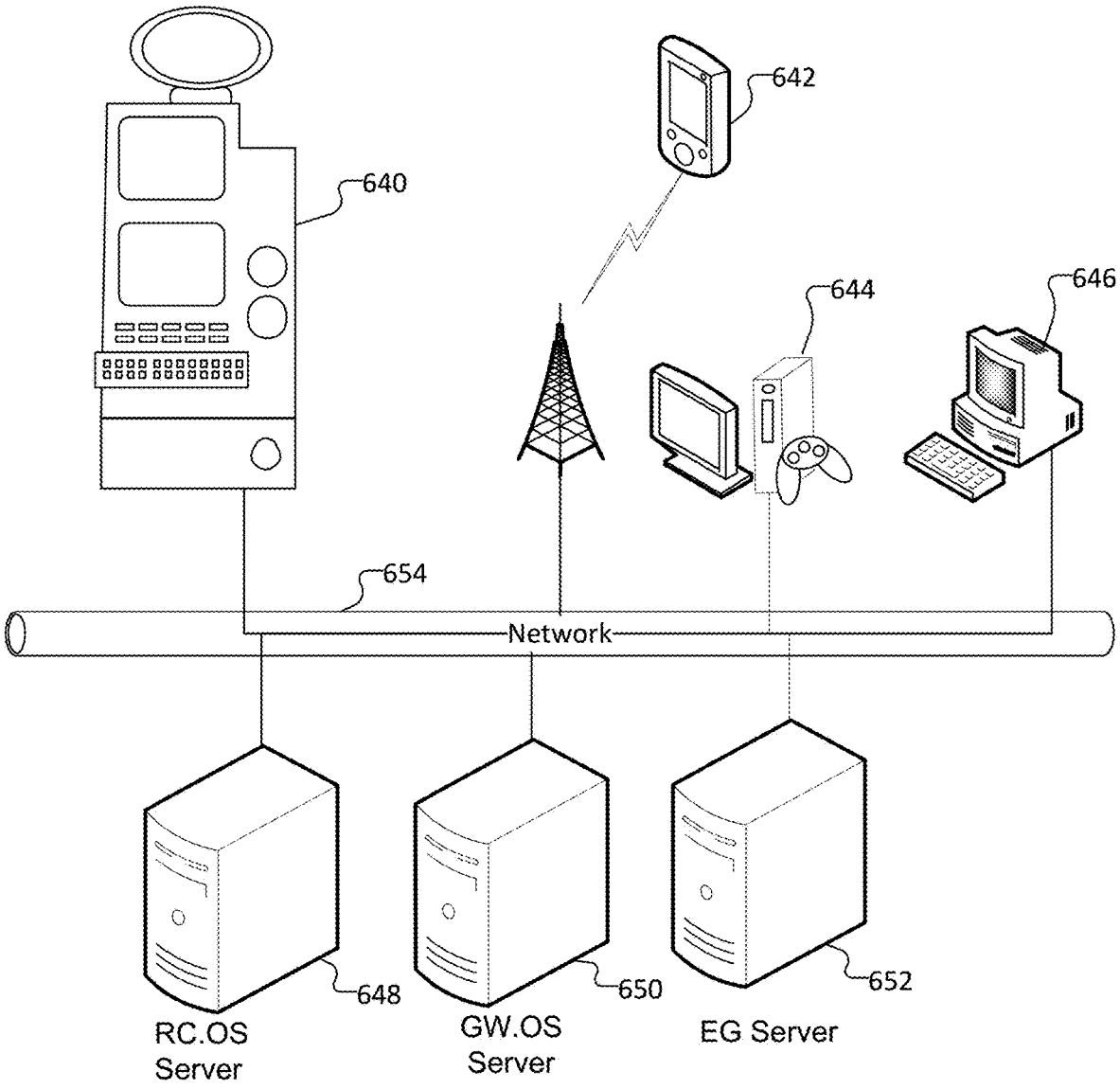

A networked sports event driven skill wagering interleaved games in accordance with still another embodiment of the invention is illustrated in FIG. 6C. As illustrated, one or more end devices of networked sports event driven skill wagering interleaved games, such as a mobile device 642, a gaming console 644, a personal computer 646, and an electronic gaming machine 640 are connected with an RC.OS server 648 and a GW.OS server 650, and an EG server 652 over a network 654. Network 654 is a communications network that allows processing systems to share data. Examples of the network 654 can include, but are not limited to, a Local Area Network (LAN) and a Wide Area Network (WAN). In some embodiments, the processes of a display and player interface of an EG as described herein are executed on the individual end devices 640, 642, 644 and 646. The processes of the RC.OS as described herein can be executed by the RC.OS server 648. The processes of the GW.OS as described herein can be executed by the GW.OS server 650 and the processes of an EG excluding the display and player interfaces can be executed by the EG server 652.

In various embodiments, a patron management server may be operatively connected to components of a sports event driven skill wagering interleaved game via a network. In other embodiments, a number of other peripheral systems, such as a player management system, a casino management system, a regulatory system, and/or hosting servers can also interface with the sports event driven skill wagering interleaved games over a network within a firewall of an operator. Also, other servers can reside outside the bounds of a network within a firewall of the operator to provide additional services for network connected sports event driven skill wagering interleaved games.

In numerous embodiments, a network distributed sports event driven skill wagering interleaved game can be implemented on multiple different types of devices connected together over a network. Any type of device can be utilized in implementing a network distributed sports event driven skill wagering interleaved game such as, but not limited to, a gaming cabinet as used in a traditional land-based casino, a mobile computing device (such as, but not limited to a PDA, smartphone, tablet computer, or laptop computer), and a game console (such as but not limited to a Sony PlayStation®, or Microsoft Xbox®) or on a Personal Computer (PC). Each of the devices may be operatively connected to other devices or other systems of devices via a network for the playing of head-to-head games.

Although various networked sports event driven skill wagering interleaved games are discussed above, sports event driven skill wagering interleaved games can be networked in any configuration as appropriate to the specification of a specific application in accordance with embodiments of the invention. In some embodiments, components of a networked sports event driven skill wagering interleaved game, such as a GW.OS, RC.OS, EG, or other servers that perform services for a GW.OS, RC.OS and/or EG, can be networked in different configurations for a specific networked sports event driven skill wagering interleaved game gameplay application. Sports event driven skill wagering interleaved game implementations are discussed herein. Processing apparatuses that can be utilized in the implementation of sports event driven skill wagering interleaved game are discussed below.

Processing Apparatuses

Figure 7:
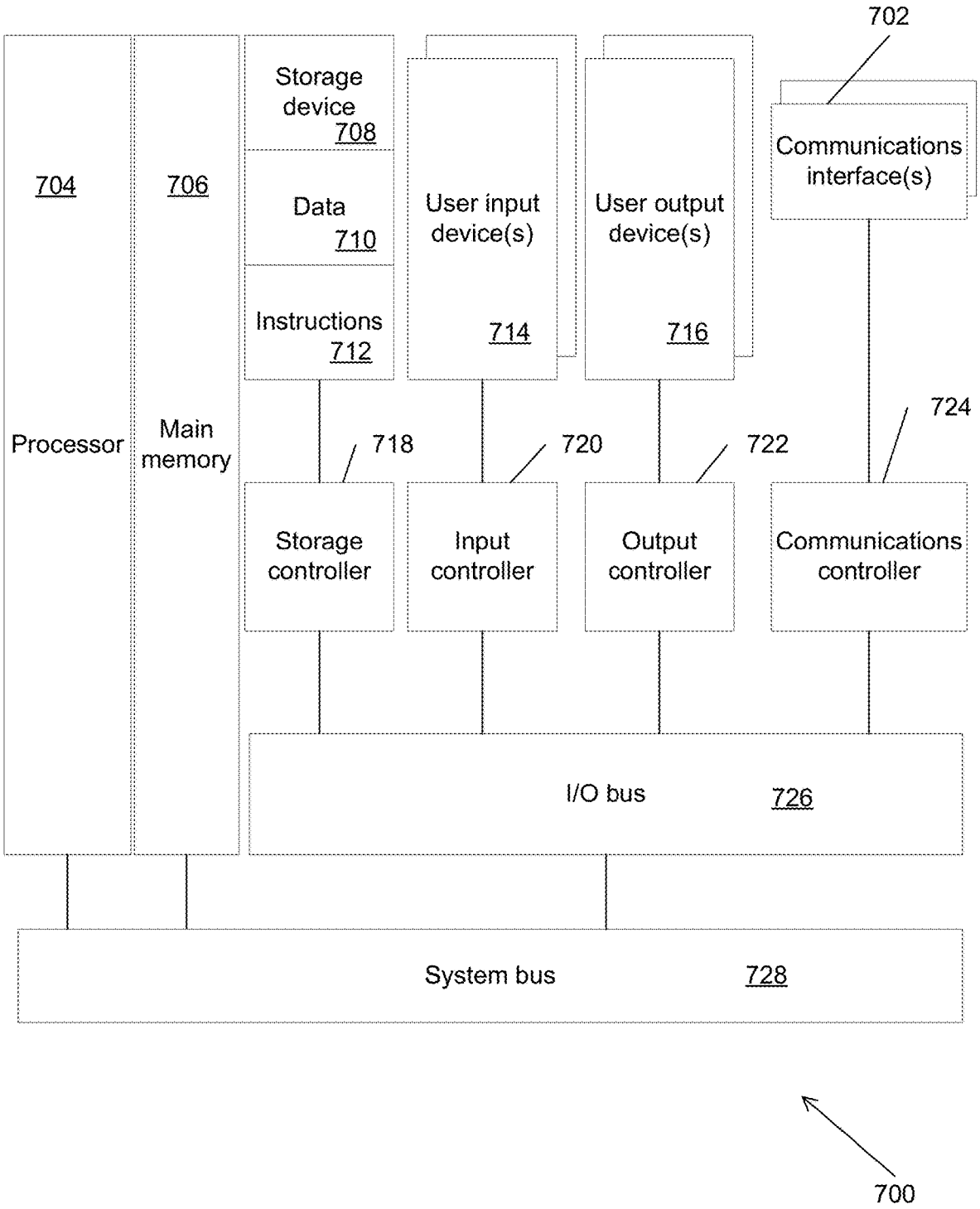
FIG. 7 illustrates a block diagram of components of a processing apparatus in accordance with various embodiments of the invention.

Any of a variety of processing apparatuses can host various components of a sports event driven skill wagering interleaved game in accordance with embodiments of the invention. In accordance with some embodiments of the invention, these processing apparatuses can include, but are not limited to, a server, a client, a mobile device such as a smartphone, a personal digital assistant or the like, a wireless device such as a tablet computer or the like, an electronic gaming machine, a general purpose computer, a gaming console, a set-top box, a computing device and/or a controller. A processing apparatus that is constructed to implement a sports event driven skill wagering interleaved game in accordance with embodiments of the invention is illustrated in FIG. 7. In the processing apparatus 700, a processor 704 is coupled to memory 706 by a system bus 728. The processor 704 is also coupled to non-transitory machine-readable storage media, such as a storage device 708 that stores executable instructions 712 and data 710 through the system bus 728 to an I/O bus 726 through a storage controller 718. The processor 704 is also coupled to one or more interfaces that can be used to connect the processor to other processing apparatuses as well as networks as described herein. The processor 704 is also coupled via the system bus 728 and I/O bus 726 to user input devices 714. Examples of input device 714 include, but are not limited to tactile devices including, but not limited to, keyboards, keypads, foot pads, touch screens, and/or trackballs; as well as non-contact devices such as audio input devices, motion sensors and motion capture devices that the processing apparatus can use to receive inputs from a user when the user interacts with the processing apparatus. The processor 704 is connected to these user input devices 714 through the system bus 728, to the I/O bus 726 and through the input controller 720. The processor 704 is also coupled via the bus to user output devices 716 such as (but not limited to) visual output devices, audio output devices, and/or tactile output devices that the processing apparatus uses to generate outputs perceivable by the user when the user interacts with the processing apparatus. In accordance with some embodiments, the processor 704 is coupled to visual output devices such as (but not limited to) display screens, light panels, and/or lighted displays. In accordance with particular embodiments, the processor 704 is coupled to audio output devices such as (but not limited to) speakers, and/or sound amplifiers. In accordance with many of these embodiments, the processor 704 is coupled to tactile output devices like vibrators, and/or manipulators. The processor 704 is connected to output devices 716 from the system bus 728 to the I/O bus 726 and through the output controller 722. The processor 704 can also be connected to a communications interface 702 from the system bus 728 to the I/O bus 726 through a communications controller 724.

In accordance with various embodiments, a processor 704 can load instructions and data from the storage device into the memory 706. The processor 704 can also execute instructions that operate on the data to implement various aspects and features of the components of a sports event driven skill wagering interleaved game. The processor 704 can utilize various input and output devices in accordance with the instructions and the data in order to create and operate user interfaces for players or operators of a sports event driven skill wagering interleaved game (such as but not limited to a casino that hosts the sports event driven skill wagering interleaved game).

Although the processing apparatus 700 is described herein as being constructed from a processor and instructions stored and executed by hardware components, the processing apparatus can be composed of only hardware components in accordance with other embodiments. In addition, although the storage device is described as being coupled to the processor through a bus, those skilled in the art of processing apparatuses will understand that the storage device can include removable media such as, but not limited to, a USB memory device, an optical CD ROM, magnetic media such as tape and disks. Also, the storage device 708 can be accessed by processor 704 through one of the interfaces or over a network. Furthermore, any of the user input devices or user output devices can be coupled to the processor 704 via one of the interfaces or over a network. In addition, although a single processor 704 is described, those skilled in the art will understand that the processor 704 can be a controller or other computing device or a separate computer as well as be composed of multiple processors or computing devices including one or more processors.

In numerous embodiments, any of an RC.OS, GW.OS or EG as described herein can be implemented on multiple processing apparatuses, whether dedicated, shared, or distributed in any combination thereof, or can be implemented on a single processing apparatus. In addition, while certain aspects and features of sports event driven skill wagering interleaved game processes described herein have been attributed to an RC.OS, GW.OS, or EG, these aspects and features can be implemented in a distributed form where any of the features or aspects can be performed by any of a RC.OS, GW.OS, and/or EG within a sports event driven skill wagering interleaved game without deviating from the spirit of the invention.

Sports Event Driven Skill Wagering Interleaved Game Implementations

Figure 8:
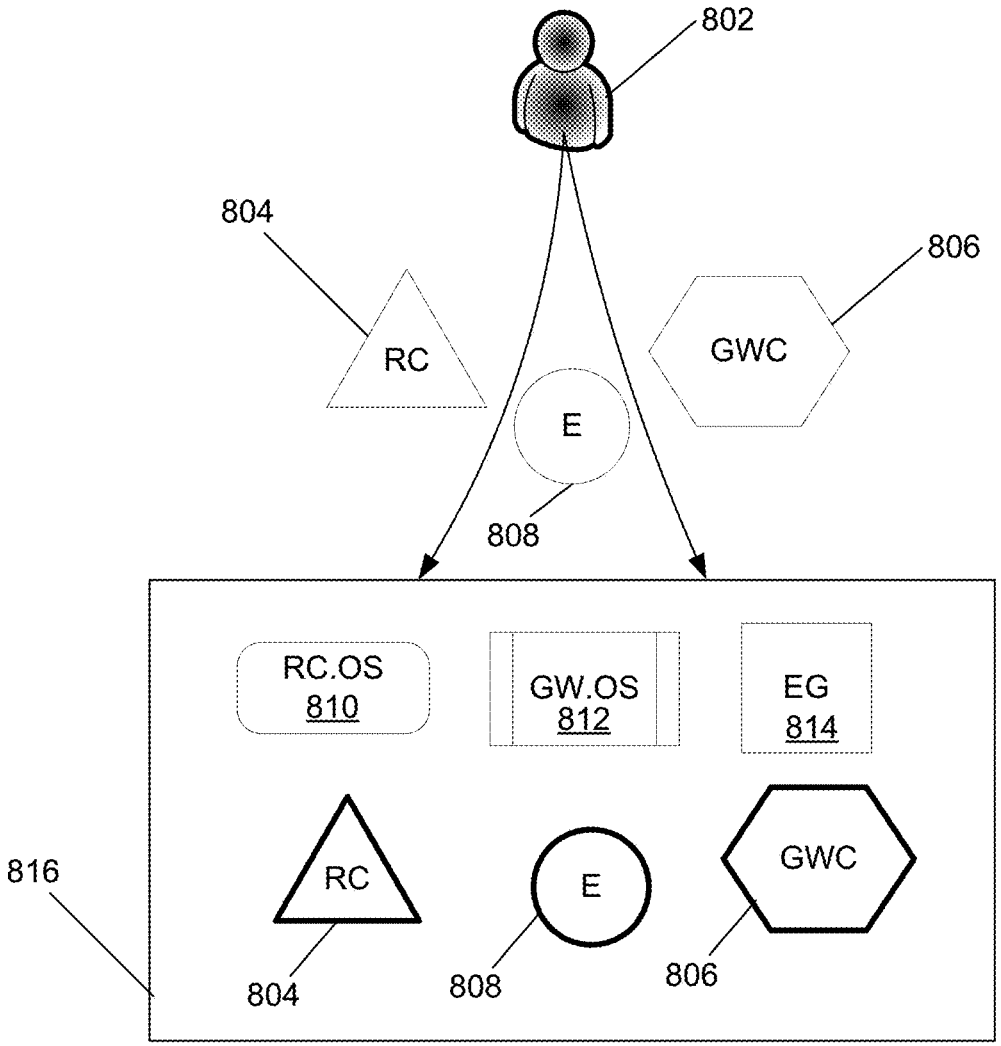
FIG. 8 illustrates a conceptual diagram of components of a sports event driven skill wagering interleaved game in accordance with an embodiment of the invention.

In several embodiments, a player can interact with a sports event driven skill wagering interleaved game by using RC in interactions with a gambling game along with GWC and elements in interactions with a sports event driven entertainment game. The gambling game can be executed by a RC.OS while a sports event driven entertainment game can be executed with an EG and managed with a GW.OS. A conceptual diagram that illustrates how resources such as GWC, RC and elements, such as but not limited to EE, are utilized in a sports event driven skill wagering interleaved game in accordance with an embodiment of the invention is illustrated in FIG. 8. The conceptual diagram illustrates that RC 804, element E 808 and GWC 806 can be utilized by a player 802 in interactions with the RC.OS 810, GW.OS 812 and EG 814 of a sports event driven skill wagering interleaved game 816. The contribution of elements, such as E 808, can be linked to a player's access to credits, such as RC 804 and/or GWC 806. Electronic receipt of these credits can come via a smart card, voucher or other portable media, or as received over a network from a server. In some embodiments, these credits can be drawn on demand from a player profile located in a database locally on a sports event driven skill wagering interleaved game or in a remote server.

Figure 9:
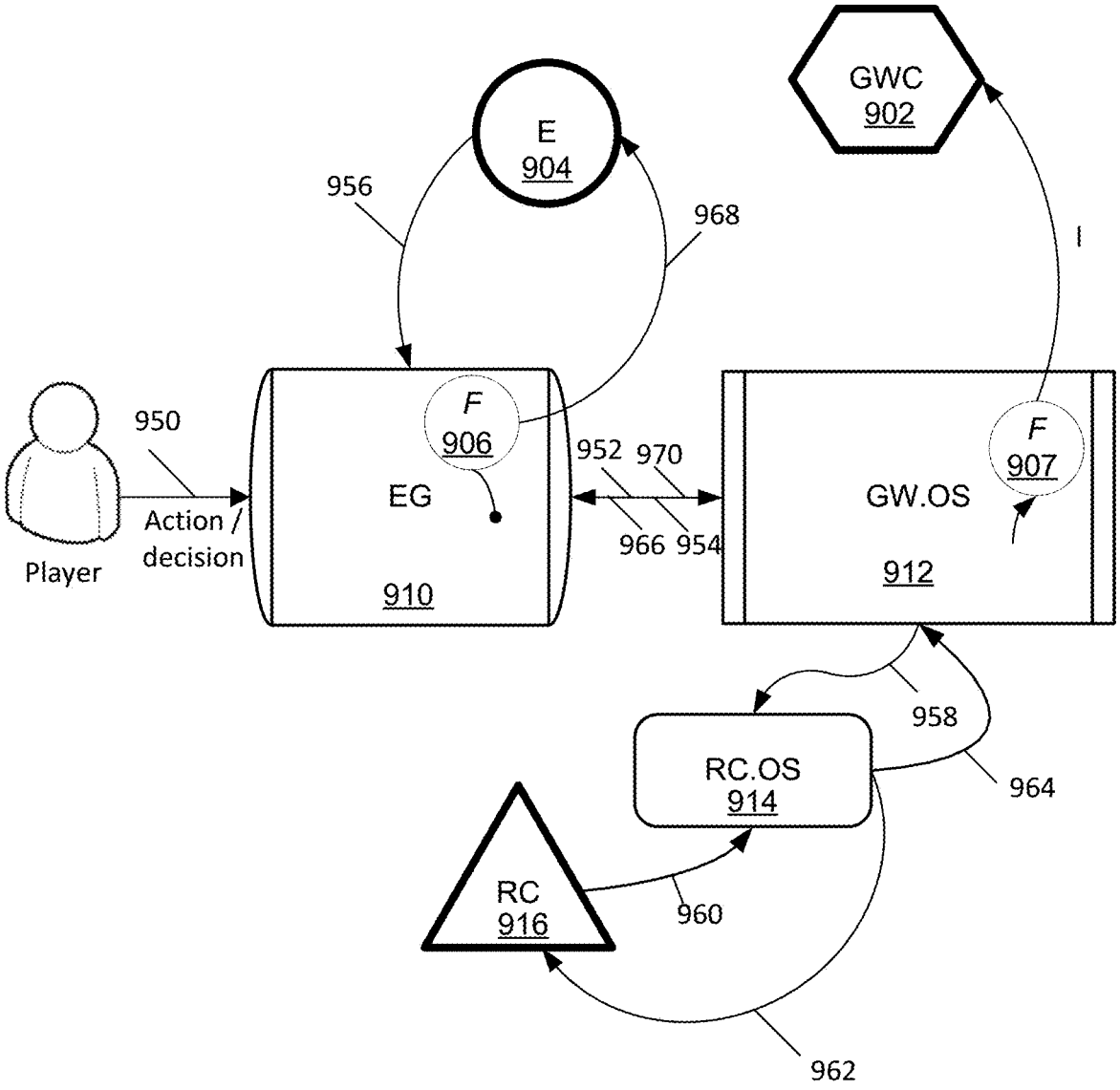
FIG. 9 illustrates a conceptual diagram of the interplay between aspects of a sports event driven skill wagering interleaved game using Real World Currency (RC) in accordance with some embodiments of the invention.

A conceptual diagram that illustrates interplay between elements and components of a sports event driven skill wagering interleaved game in accordance with an embodiment of the invention is illustrated in FIG. 9. Similar to FIG. 8, a player's actions and/or decisions can affect functions 906 and 907 that consume and/or accumulate GWC 902 and/or E 904 in a sports event driven entertainment game executed by an EG 910, a RC.OS 914 and a GW.OS 912. The GW.OS 912 can monitor the activities taking place within a sports event driven entertainment game executed by an EG 910 for gameplay gambling event occurrences. The GW.OS 912 can also communicate the gameplay gambling event occurrences to the RC.OS 914 that triggers a gambling event and/or wager of RC 916 in a gambling game executed by the RC.OS 914.

In the illustrated example, the player commences interaction with the sports event driven skill wagering interleaved game by contributing one or more of three types of credits to the sports event driven skill wagering interleaved game: (i) RC 916 which is a currency fungible instrument, (ii) GWC 902 which are game world credits, and (iii) E 904 which is an enabling element of the entertainment portion of the sports event driven skill wagering interleaved game executed by the EG. In many embodiments, an element is an element consumed by, traded or exchanged in, operated upon, or used by the player during the player's play of the sports event driven entertainment game portion of the sports event driven skill wagering interleaved game. There may be one or more types of E present in a sports event driven skill wagering interleaved game's entertainment game. Embodiments of E include, but are not limited to, bullets in a shooting game, fuel in a racing game, letters in a word spelling game, downs in a football game, portions in a character adventure game, and/or character health points, etc.

The contribution of one or more of these elements may be executed by insertion into the sports event driven skill wagering interleaved game of currency in the case of RC, and/or transferred in as electronic credit in the case of any of the RC, GWC and/or E. Electronic transfer in of these credits may come via a smart card, voucher or other portable media, or as transferred in over a network from a patron server or sports event driven skill wagering interleaved game player account server. In many embodiments, these credits may not be transferred into the sports event driven skill wagering interleaved game. Instead the credits may be drawn on demand from player accounts located in servers residing on the network or in the cloud on a real time basis as the credits are consumed by the sports event driven skill wagering interleaved game. Once these credits are deposited, or a link to their availability is made, the sports event driven skill wagering interleaved game has the credits at its disposal to use for execution of the sports event driven skill wagering interleaved game. Generally, the RC is utilized and accounted for by the RC.OS 914; and the E 904 and GWC 902 are utilized and accounted for by the GW.OS 912 and/or the EG 910.

In accordance with some embodiments of the invention, the following may occur during use of the sports event driven skill wagering interleaved game. The user enters an input that represents an action or decision (950). The EG 910 signals the GW.OS 912 with the input decision or action (952). The GW.OS 912 responds by signaling to the EG 910 the amount of E that is consumed by the player action or decision (954). The signaling from the GW.OS 912 configures a function 906 to control the E consumption, decay, and/or accumulation.

The EG 910 then adjusts the E 904 accordingly (956). The GW.OS 912 signals the RC.OS 914 as to the profile of the wager proposition associated with the action or decision and triggers a gambling event and the wager (958). The RC.OS 914 consumes the appropriate amount of RC 916, executes the gambling event and resolves the wager (960). The RC.OS 914 then adjusts the RC 916 based upon the outcome of the wager (962) and informs the GW.OS 912 as to the outcome of the wager (964).

The GW.OS 912 signals the EG 910 to adjust E to one or more of the Es of the EG entertainment game (966). Function 906 of the EG 910 performs the adjustment of E 904 (968). The EG 910 signals the GW.OS 912 as to the updated status (970). In response, the GW.OS 912 updates the GWC 902 using a function 907 (972) and may provide an update of the GWC to the EG 910.

The following is an example of the above flow in a first person shooter game, such as Call of Duty®, using a sports event driven skill wagering interleaved game sequence in accordance with embodiments of the invention.

The process begins by a player selecting a machine gun to use in the game and then fires a burst of bullets at an opponent (950). The EG 910 can signal to the GW.OS 912 of the player's choice of weapon, that a burst of bullets was fired, and/or the outcome of the burst (952). The GW.OS 912 processes the information received and signals the EG 910 to consume 3 bullets (E) with each pull of the trigger (954). The EG 910 consumes 3 bullets for the burst using function 906 (956).

The GW.OS 912 signals the RC.OS 914 that 3 credits (RC) are to be wagered on the outcome of a gambling event to match the three bullets consumed. The RC.OS 914 then performs the gambling event and determines the result of the wager and may determine the winnings from a pay table. The RC.OS 914 consumes 3 credits of RC 916 for the wager and executes the specified wager (960). By way of example, the RC.OS 914 may determine that the player hit a jackpot of 6 credits and returns the 6 credits to the RC 916 (962) and signals the GW.OS 912 that 3 net credits were won by the player (964).

The GW.OS 912 signals the EG 910 to add 3 bullets to an ammunition clip (966). The EG 910 adds 3 bullets back to the ammo clip (E 904) using a function 906 (968). The ammunition may be added by directly adding the ammunition to the clip or by allowing the user to find extra ammunition during gameplay. The GW.OS 912 logs the new player score (GWC 902) in the game (as a function of the successful hit on the opponent) based on the EG 910 signaling, and adds 2 extra points to the player score since a jackpot has been won (970). The GW.OS then adds 10 points to the player score (GWC 902) given the success of the hit which in this example is worth 8 points, plus the 2 extra points (972). Note that the above example is only intended to provide an illustration of how credits flow in a sports event driven skill wagering interleaved game, but is not intended to be exhaustive and only lists only one of numerous possibilities of how a sports event driven skill wagering interleaved game may be configured to manage its fundamental credits.

Note that the foregoing embodiments are intended to provide an illustration of how credits flow in a sports event driven skill wagering interleaved game, but are not intended to be exhaustive, and only list one of numerous possibilities of how a sports event driven skill wagering interleaved game may be configured to manage its fundamental credits.

In accordance with some embodiments, the sports event driven skill wagering interleaved game system of FIG. 9 may provide a sports event driven skill wagering interleaved game with virtual currency versus using RC. Virtual currency can be thought of as a form of alternate currency which can be acquired, purchased or transferred in unit or in bulk by/to a player but does not necessarily directly correlate to RC or real currency. In a number of embodiments, there is a virtual currency called "Triax Jacks". 1000 units of "Triax Jacks" are given to a player by an operator of a sports event driven skill wagering interleaved game with additional blocks of 1000 units being available for purchase for $5 USD for each block. Triax Jacks could be redeemed for various prizes. Alternatively, the Triax Jacks could never be redeemed but simply used and traded purely for entertainment value by players. It would be completely consistent with the architecture of the sports event driven skill wagering interleaved game that Triax Jacks would be wagered in place of RC such that the sports event driven skill wagering interleaved game could be played for free or with played with operator sponsored Triax Jacks.

Provision of a Sports Event Driven Skilled Interleaved Game

A mechanism by which events that take place within organized sporting events associated monitored by an entertainment game are used, along with additional information and/or inputs in some embodiment, to initiate gambling games is provided in accordance with some embodiments.

In many embodiments, the sporting events are sporting contests monitored by the entertainment game. In many embodiments, the sporting events are sporting contests that are simulated during play of the entertainment game provided by the EG.

The concept of a sports book is well known in the gambling industry. In a sports book, players may wager on propositions about the outcome of various sporting games. The propositions are odds adjusted and relate not only to the ultimate outcome of a sporting game, but can also relate to various other measures of team and/or individual performance across one or more games, including an entire season of games, playoffs, etc.

In accordance with some embodiments of this invention, intermediate points and events within a game, as well as the ultimate outcome of a game and/or games, can be used to trigger gambling events and/or wagers on an outcome of a gambling event. Participants can therefore augment (or replace) conventional sports book wagering with one or more gambling games initiated by in-game events or actions.

Figure 10:
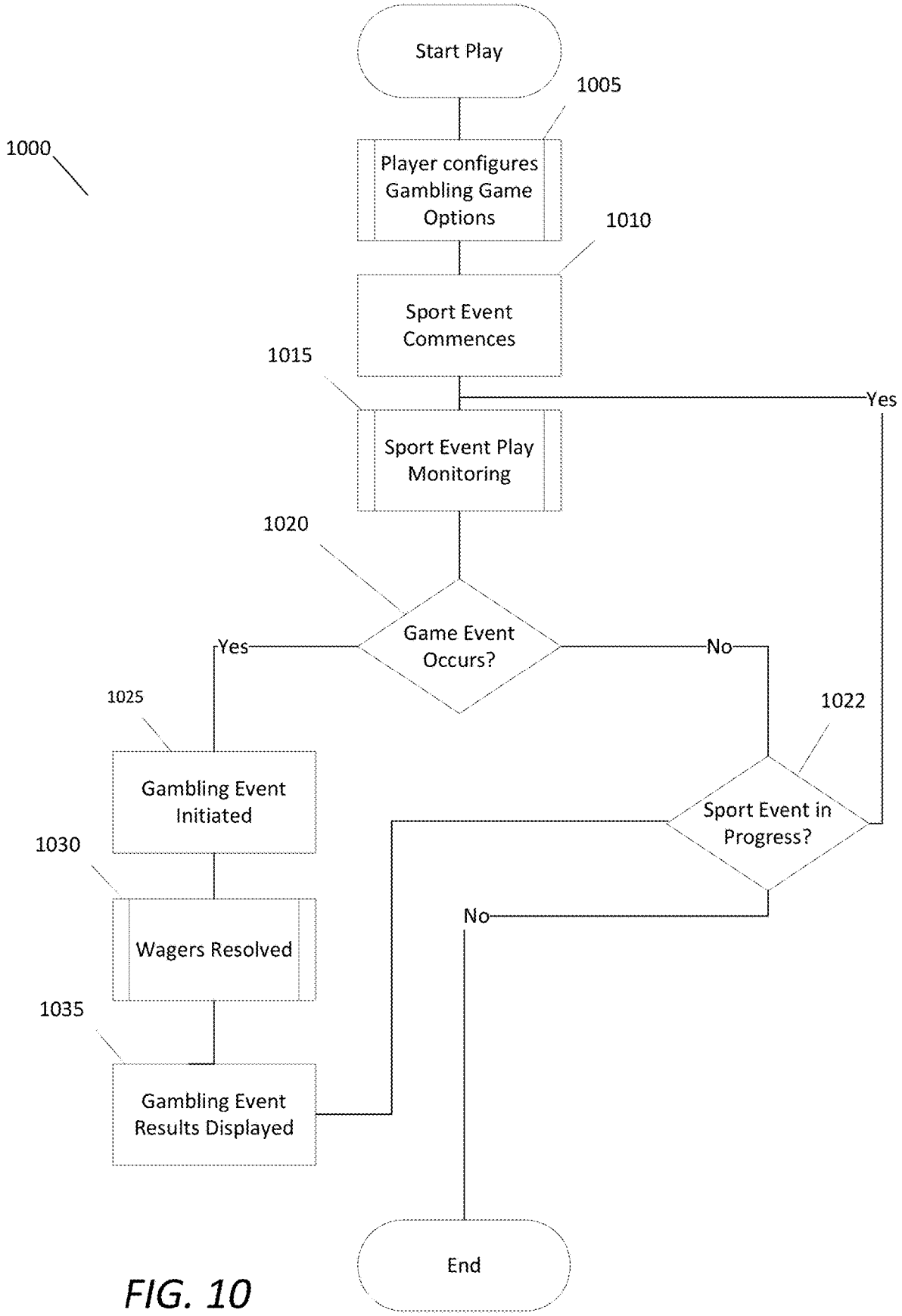
FIG. 10 illustrates a flow diagram of a process for configuring and playing a sports event driven skill wagering interleaved game in accordance with an embodiment of the invention.

A flow chart of a process performed by a sports event driven skilled interleaved game to provide gambling events based upon actions in a sporting event in accordance with an embodiment of the invention is shown in FIG. 10. In process 1000, the participant configures gambling game options (1005). In some embodiments, the configuration of gambling game options includes the participant selecting a sporting event of interest to be monitored by the sports driven entertainment game provided by the EG and configuring a series of gambling mechanics before the sporting event commences. The participant also makes selections as to the amount of money to be gambled and/or sets other controls on the flow of player funds into and out of the gambling games that will be associated with the sporting event of interest in many embodiments.

Once the sporting event commences (1010), the sports event driven skilled interleaved game monitors the sporting events of in-game events and/or actions (1020). Gambling events in the one or more gambling games are initiated as a result of in-game events and/or actions during the sporting event in accordance with the player's established preferences (1025). The results of gambling events are determined and associated wagers on the outcome of the gambling event are resolved using information provided in the players 1030. The gambling games can take a wide array of forms, including, but not limited to, pseudo-slot machines, roulette wheels, or any other game of chance in various embodiments.

Gambling events in the gambling games continue to be triggered during the sporting game in accordance with the player's preferences until the player causes the triggering to cease, the player runs out of money, or other conditions set by the player, casino, and/or regulator are met (1022).

For example, consider game 5 of the Stanley Cup Finals between the Boston Bruins and Chicago Blackhawks. Participants can bet on the outcome of the game itself within a conventional sports book. In some embodiments of this invention, participants can also initiate gambling games as a function of in-game actions by the players on either or both teams. In this example, a participant configures the gambling games in the following manner. The participant selects a team (BRUINS) and one of a number of available slot machine games. The participant then selects to a specific player to attach to a specific slot machine game. Each slot machine game can have different characteristics including, but not limited to, denomination, distribution of outcomes, volatility, graphical elements, access to bonus rounds, etc. The participant repeats the selection process as many times as the participant desires. The participant can attach as few as one gambling game and as many as the number of players, player activities, and/or in-game events supported by the sports driven entertainment game.

The participant can also commit funds to the sports event driven skilled interleaved game. These funds can be cashed out at any time. In this example, a shot on net by any of the participant's selected players initiates a slot machine game. If the player scores, a free (though it could also be paid) bonus slot machine is initiated that exposes the player to the possibility of a substantial jackpot. In some embodiments, the participant can attach gambling games to players and/or events and/or actions related to either team or both teams.

Although specific processes for providing a sports event driven skilled interleaved game is described above with respect to FIG. 10, any of a variety of processes may be utilized to determine the results of gambling events in accordance with embodiments of the invention.

Figure 11:
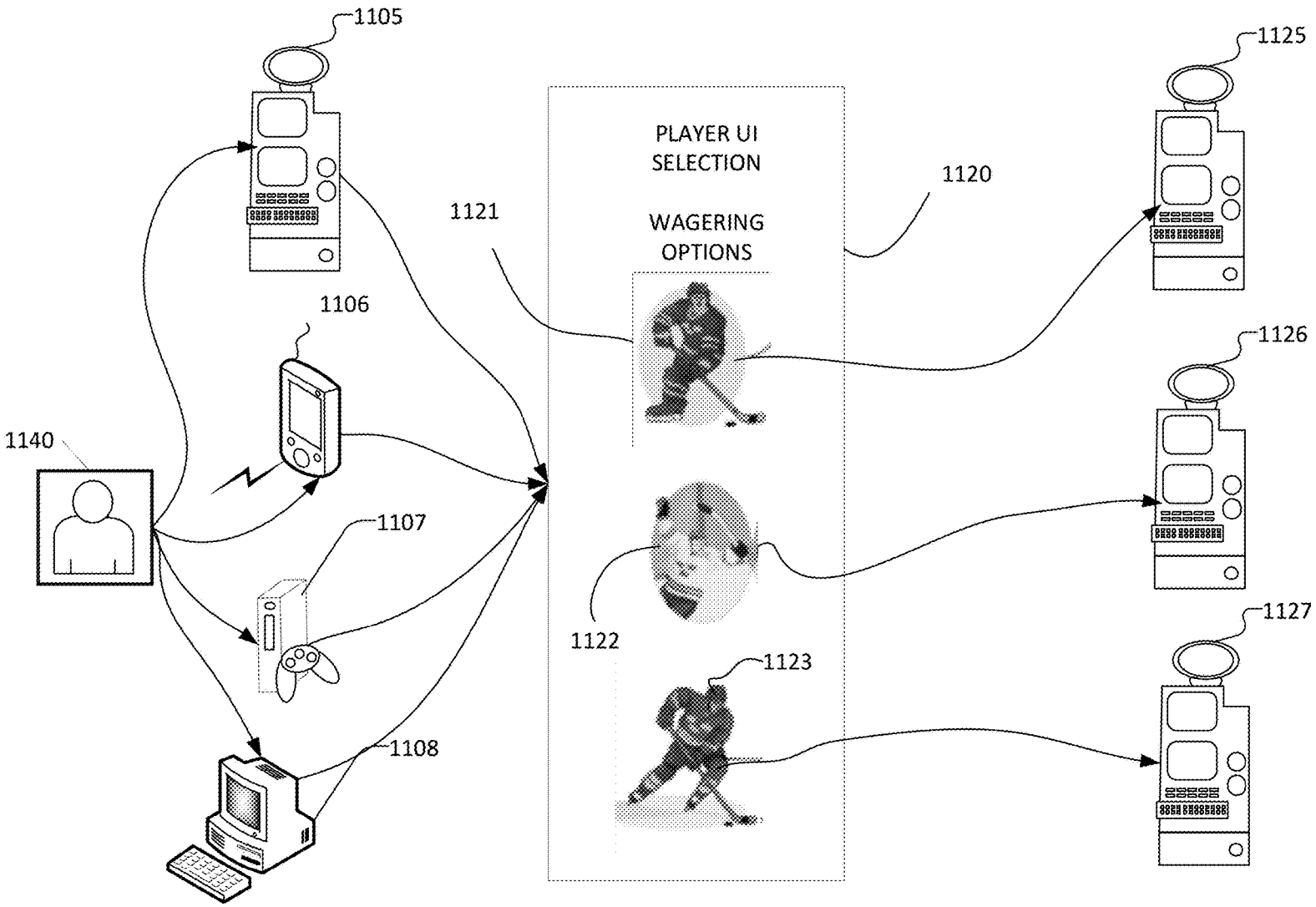
FIG. 11 illustrates an embodiment of a distributed sports event driven skill wagering interleaved game in accordance with an embodiment of the invention.
Figure 12:
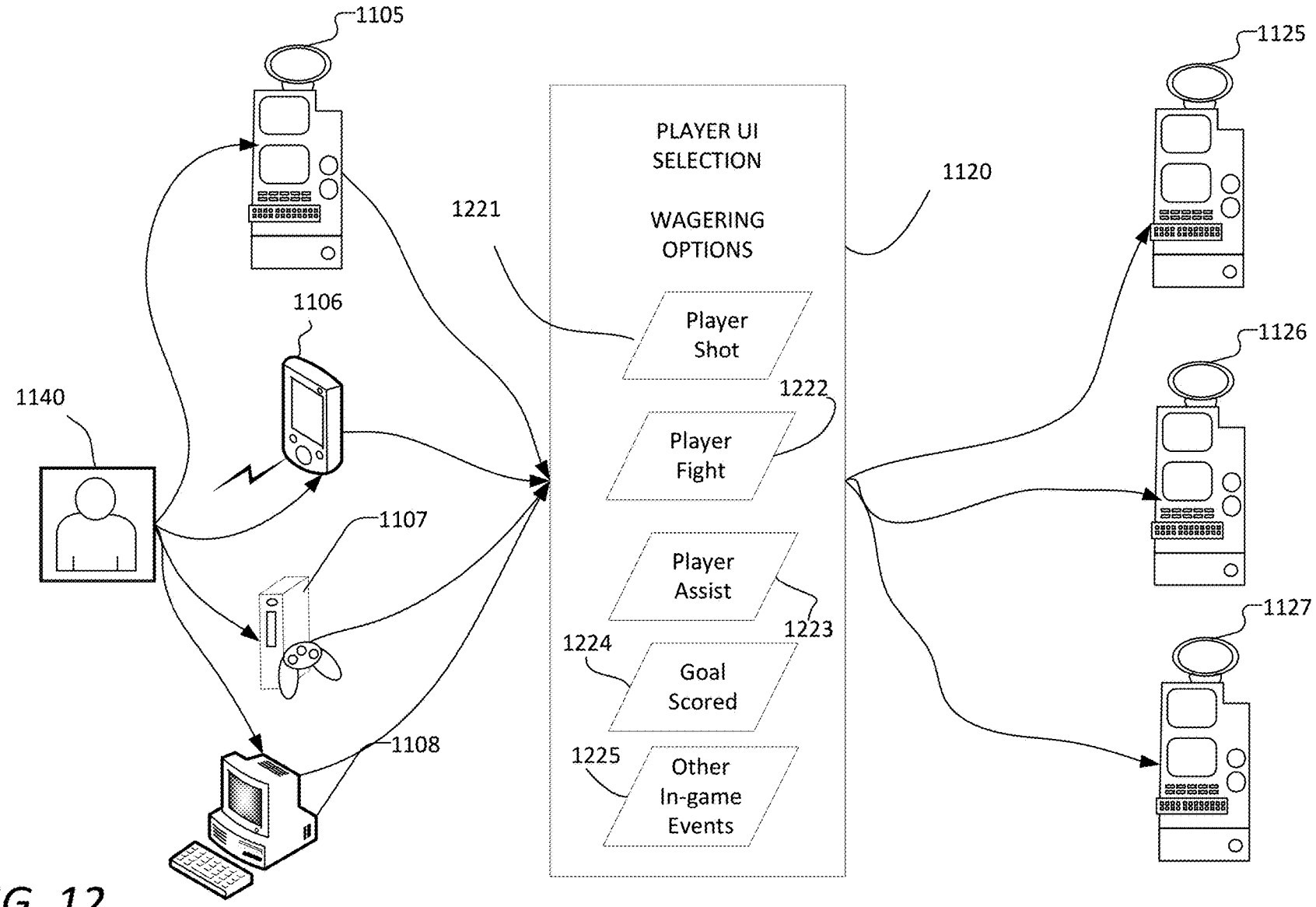
FIG. 12 illustrates an embodiment of a distributed sports event driven skill wagering interleaved game in accordance with another embodiment of the invention.

A conceptual diagram of the manner in which a player associates an event in a game with a gambling game in accordance with an embodiment of a sports event driven skilled interleaved game is shown in FIGS. 11 and 12. Player 1140 uses a player UI 1120 on a device 1105-1108 providing the sports event driven skill interleaved game. In many embodiments, player 1140 can attach gambling games 1125-1127 (e.g. slot machine games) to one or more players 1121-1123 to one or more of a multitude of player actions and/or events 1221-1225 so that a gambling event in one of gambling games 1125-1127 is triggered when the player performs the one of the designated player 1121-1123 performs a designated action 1221-1225. Examples of actions and/or events in a hockey context include, but are not limited to, a player shot on goal 1221, a player hitting another player, a player assist on a goal 1223, a face-off win by a player, the involvement of a player in a fight 1222, a player receiving a penalty, a goal scored by a player 1224, a team penalty drawn (i.e. power play initiated for team), and a save by a player.

In some embodiments, the gambling games can be initiated over multiple games. For example, a winning outcome by a baseball team in a game could initiate a gambling game, and a participant could configure the gambling mechanics such that a gambling event is initiated for each win by the team throughout the entire 162 game MLB regular season.

In accordance with various embodiments of the invention, the sports driven entertainment game may monitor a game in one or more sports including, but not limited to, basketball, football, soccer, hockey, baseball, tennis, horse racing, and boxing.

In some embodiments, a gambling event can be initiated as a result of the relative performance of two or more players or teams relative to a predetermined measure. For example, gambling games could be initiated as a function of the goal differential (if greater than zero) between two players from opposing teams in a game such as Sidney Crosby of the Penguins and Milan Lucic of the Bruins when the Penguins play the Bruins. If, at the end of the game, Crosby had two goals and Lucic none, then two gambling events would be initiated based on the goal differential of the players.

In accordance with some embodiments of this invention, a player can gamble in the manner described either on-line or at a terminal in a casino. The display provides the mechanism to configure the betting process in relation to a specific sporting event or series of sporting events. Once the sporting event has commenced, the display provides a graphical view of the game in the context of the events or actions that initiate gambling events in many embodiments. A separate window or portion of the screen may also show a direct video feed of the game in a number of embodiments. When a gambling event is initiated, the display shows the gambling game in action as well as the result of the gambling event in some embodiments. Complete statistics regarding the gambling game including, but not limited to, player credits, amount bet, amount won, and gambling game results of relevance to the gambling game are also provided by the display in numerous embodiments. The user interface also includes means by which the player can commit or withdraw funds to/from the sports event driven skilled interleaved game in some embodiments.

Figure 13:
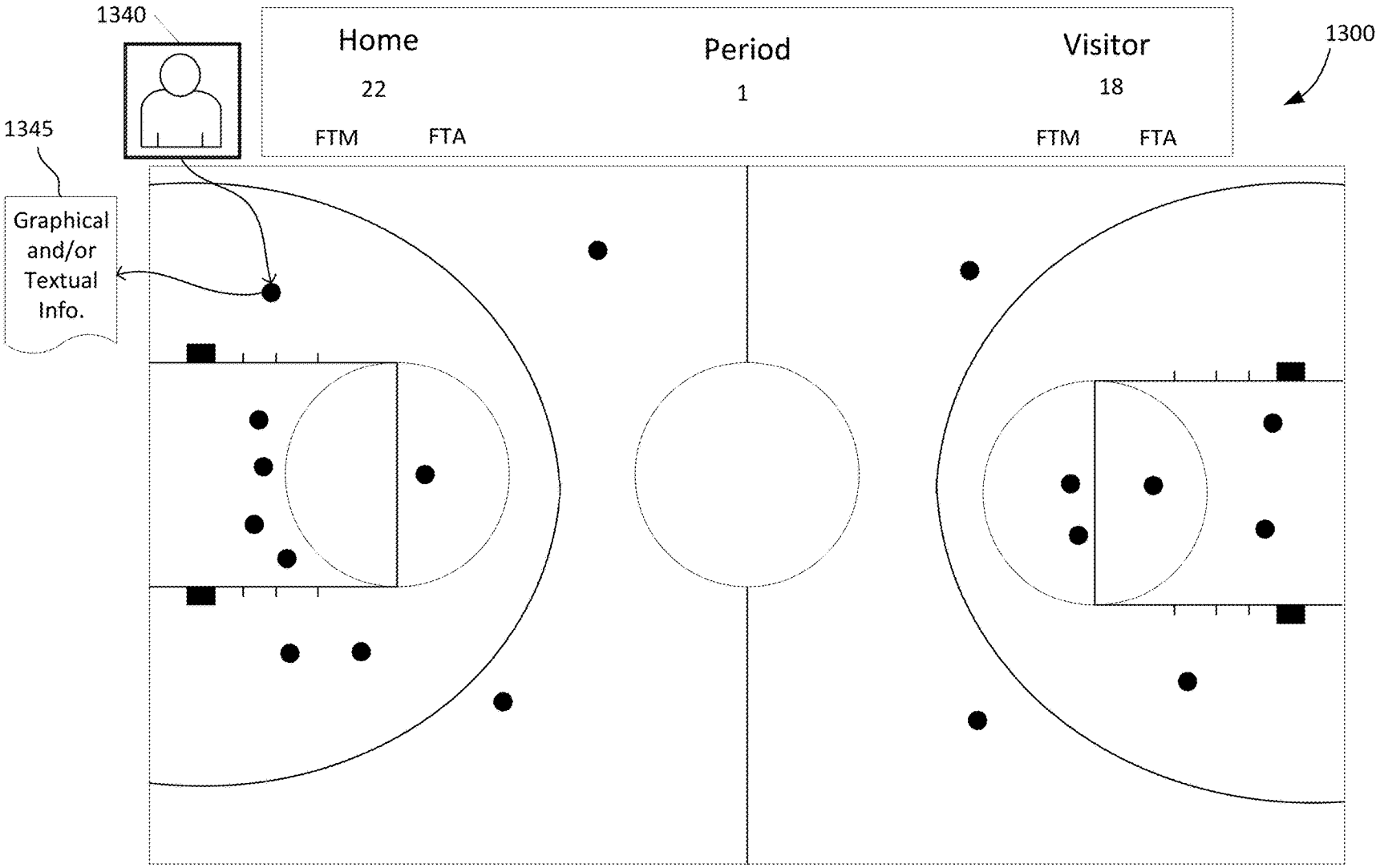
FIG. 13 illustrates a player User Interface (UI) of a sports event driven skill wagering interleaved game in accordance with an embodiment of the invention.

A display for a sports event driven skilled interleaved game in accordance with an embodiment of an invention where the entertainment game is monitoring a basketball game is shown in FIG. 13. Display 1300 shows a basketball shot chart 1300 for field goals made during a period of play in the basketball game being monitored. Each shot is provided as graphical and/or textual information 1345 to the display and indicates the trigger of a gambling event in a gambling game.

Figure 14:
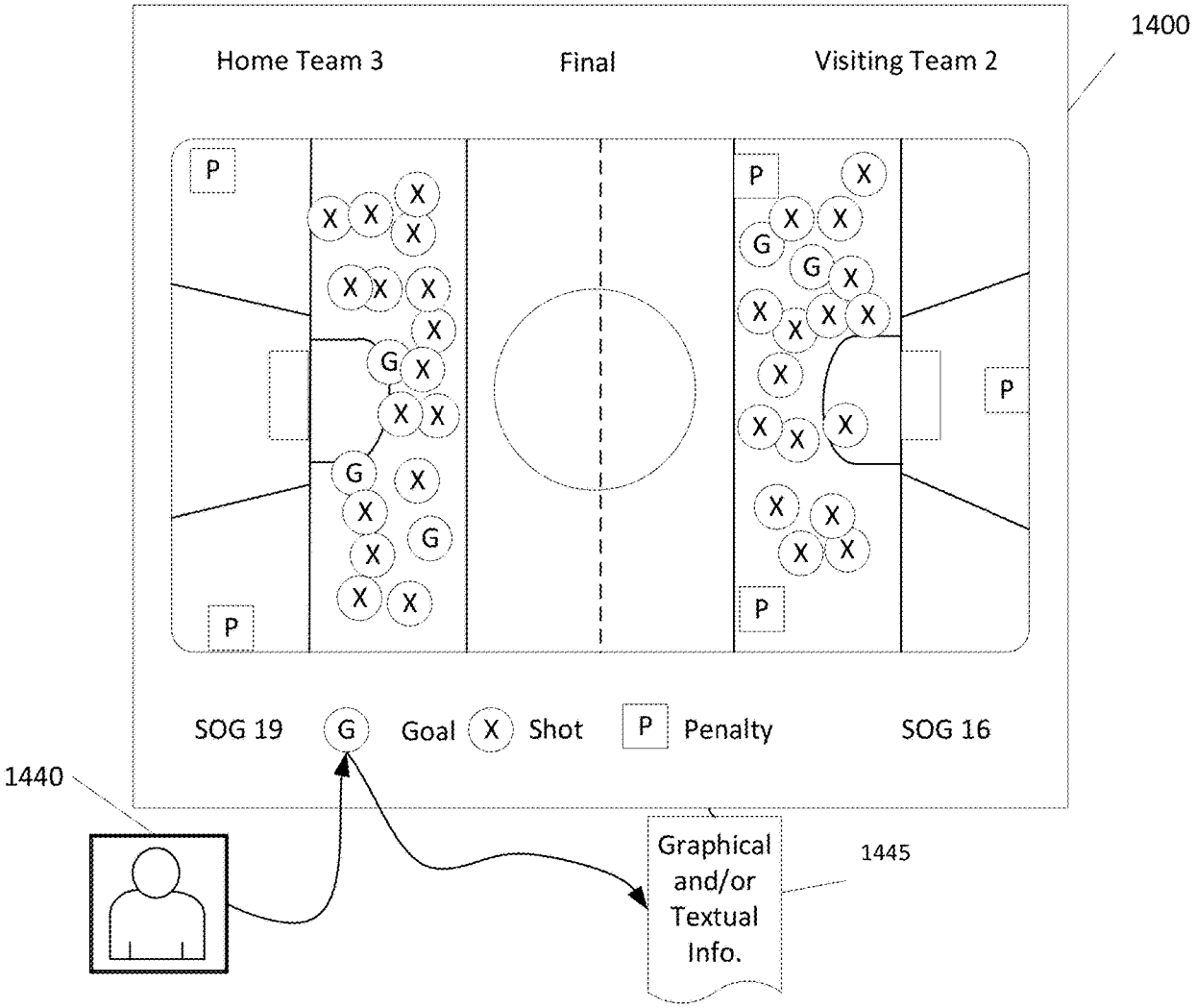
FIG. 14 illustrates a player User Interface (UI) of a sports event driven skill wagering interleaved game in accordance with another embodiment of the invention.
Figure 15:
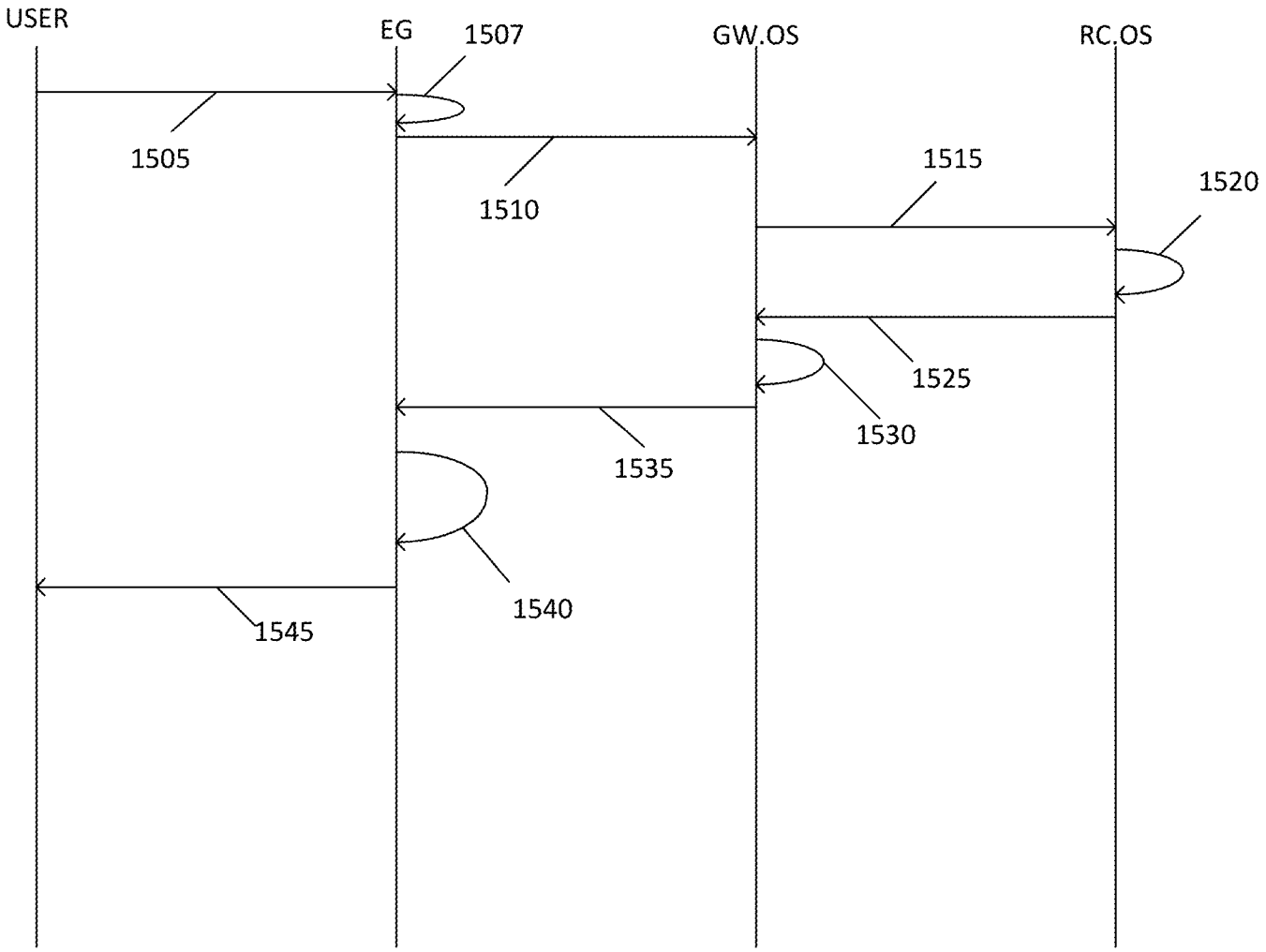
FIG. 15 illustrates a timing diagram of a process for providing a sports event driven skill wagering interleaved game in accordance with an embodiment of the invention.

A display for a sports event driven skilled interleaved game in accordance with an embodiment of an invention where the entertainment game is monitoring a hockey game is shown in FIG. 14. Display 1400 shows a representative hockey rink showing a chart of events during the game being monitored. Each shot on goal, goal scored and penalty taken are shown by icons on the rink providing graphical and/or textual information 1445 to the using and indicating the trigger of a gambling event in a gambling game.

Process for Providing a Sports Event Driven Skilled Interleaved Game

A system that provides a sports event driven skilled interleaved game, as described above, in accordance with embodiments of this invention is shown in FIGS. 15-18. A timing diagram of the information passed between various components of a sports event driven skilled interleaved game is shown in FIG. 24. The process begins when the EG interacts with the player providing the entertainment game to obtain gambling game options (1405). In some embodiments, the configuration of gambling game options includes the participant selecting a sporting event of interest to be monitored by the sports driven entertainment game provided by the EG and configuring a series of gambling mechanics before the sporting event commences. The participant may also make selections as to the amount of money to be gambled and/or sets other controls on the flow of player funds into and out of the gambling games that will be associated with the sporting event of interest in many embodiments. The EG then monitors the sporting event and generates game update information based upon progression of the sporting event (1507). The EG provides the game update information to the GW.OS (1510). The GW.OS then determines that a gambling event is triggered based on the game update information. To resolve the gambling event, the GW.OS provides a request (1515) for the gambling event to the RC.OS. The RC.OS then determines the result of the gambling event (1520). The result of the gambling event is then provided by the RC.OS to GW.OS (1525). The GW.OS then may determine a reward to provide the player based on the gambling game result (1530). The GW.OS also provides information pertaining to the results of the gambling event to the EG (1535). The EG updates the user interface according to the received gambling events results (1540) and presents the updated interface to the player while providing the entertainment game (1545).

Although specific processes performed by a sports event driven skilled interleaved game is described above with respect to FIG. 15, any of a variety of processes may be utilized to determine the results of gambling events in accordance with embodiments of the invention.

Figure 16:
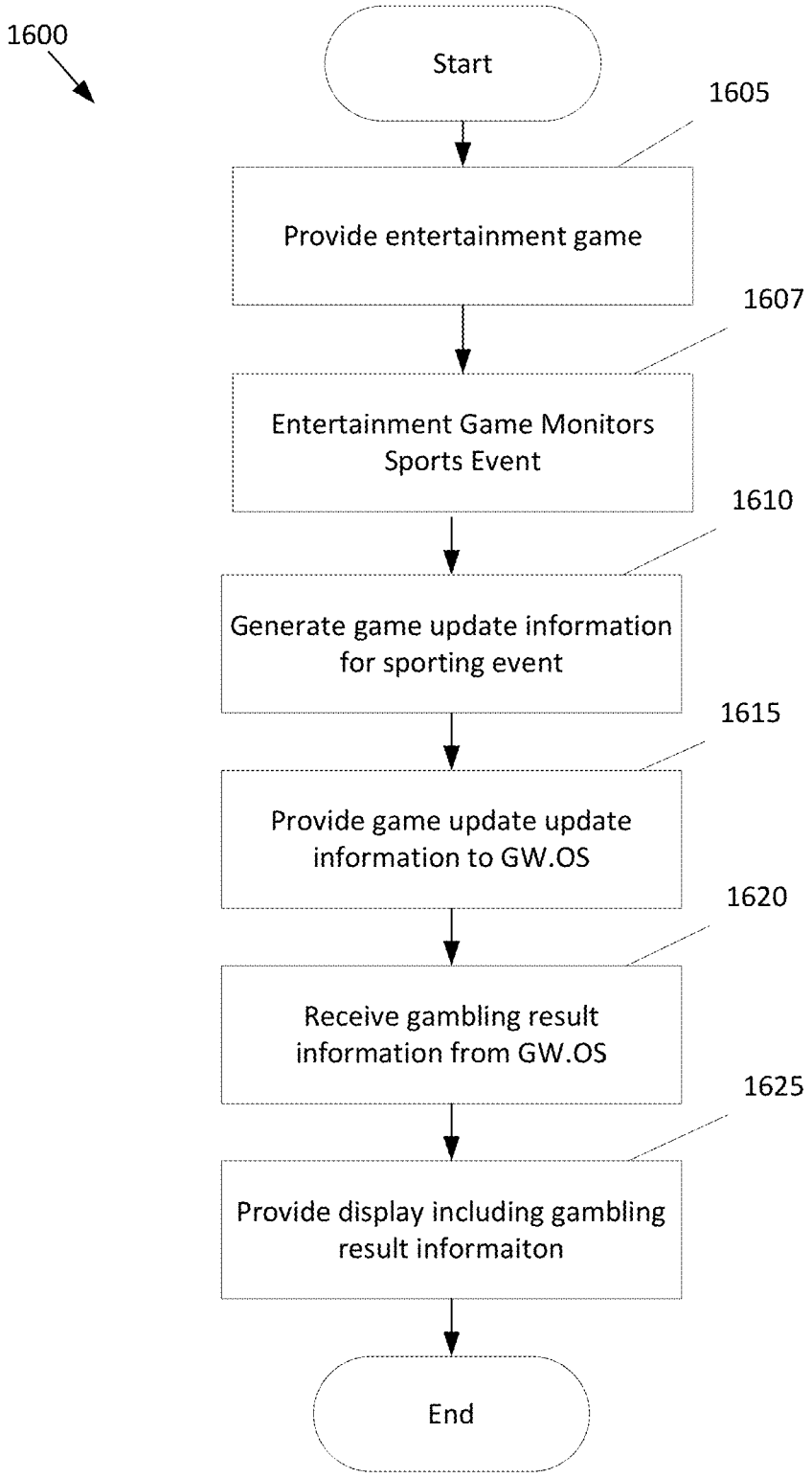
FIG. 16 illustrates a flow diagram of a process performed by an entertainment game to monitor a sports event to detect actions that occur in the sports event in accordance with embodiments of the invention.

A process performed by an EG for providing an entertainment game that monitors a sporting event in accordance with an embodiment of this invention is shown in FIG. 16. In process 1600, the EG provides the entertainment game (1605). The entertainment game monitors a sporting event (1607). In accordance with some embodiments, the entertainment game monitors the updates of a sporting event as the event is being played. In accordance with many embodiments, the entertainment game may monitor the sporting event based on information provided at some time after the conclusion of the sporting event. In accordance with the number of embodiments, the entertainment game monitors the game play of a simulated sporting event that is played as part of the entertainment game. During the monitoring of the sporting event, the entertainment game provided by the EG generates game update information (1610). The game update information indicates actions that have occurred during play of the sporting event. In accordance with some embodiments, the game update information includes information including, but not limited to, an action and/or event that occurred during game play, the player(s) that performed the action of the event, the result of the event, and/or the time period during which the action and/or event occurred. The sports update information is provided to the GW.OS by the EG (1615). The EG may then receive gambling event result information from the GW.OS (1620) and the EG updates the display of an interface accordingly (1625) and provides the display of the interface to the player.

Although specific processes performed by the EG to monitor a sports event for a sports event driven skilled interleaved game is described above with respect to FIG. 16, any of a variety of processes may be utilized to determine the results of gambling events in accordance with embodiments of the invention.

Figure 17:
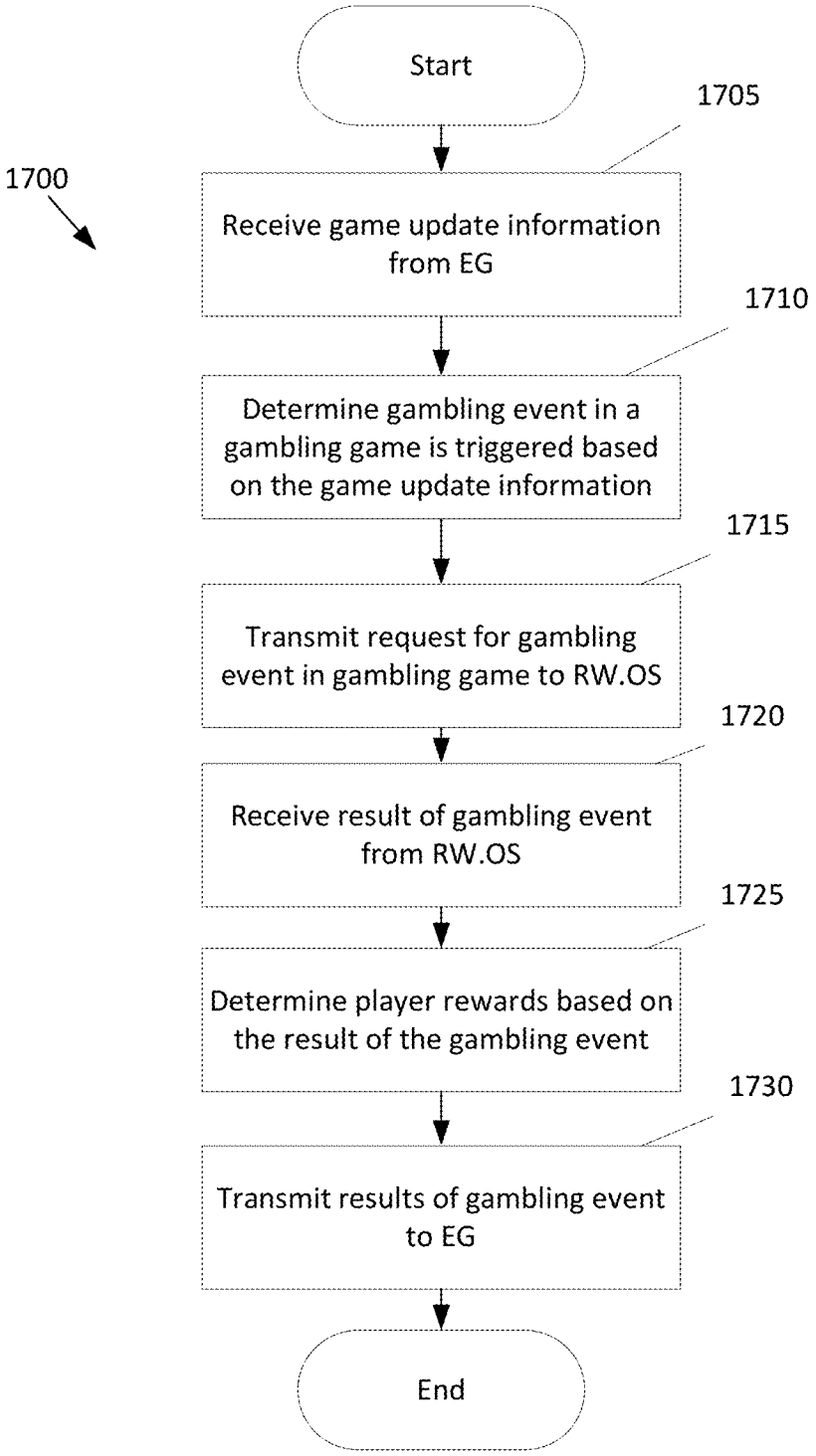
FIG. 17 illustrates a flow diagram of a process performed by a game world operating system to trigger gambling events in a gambling game based upon actions that occur during a sports event in accordance with an embodiment of the invention.

A process for determining a gambling event is triggered based on information about the monitored sporting event performed by a GW.OS in accordance with an embodiment of this invention is shown in FIG. 17. In process 1700, the GW.OS receives game update information from the EG (1705). In accordance with some embodiments of the invention, the game update information may include information including but not limited to, an action and/or event that occurred during game play, the player(s) that performed the action of the event, the result of the event, and/or the time period during which the action and/or event occurred. The GW.OS then determines a gambling event is triggered based on the game update information (1710). The determination may be made by any metric in the sporting event that may indicate that a gambling event associated with game play is to occur. Furthermore, as described above, the GW.OS may also determine the particular gambling game in which a gambling event is triggered based upon the game update information in accordance with many embodiments. The GW.OS then requests the determined gambling event be performed by the RC.OS (1715). The request may include the amount of RC to wager on a proposition about the result of the event and the gambling game for which the event is triggered in accordance with some embodiments. The GW.OS then receives the results of the gambling event from the RC (1720). The results provided to the GW.OS may also include RNG results and other information. The results of the gambling events may be used by the GW.OS to determine entertainment game and other player awards (1725) in accordance with some embodiments. The gambling event results are then transmitted by the GW.OS to the EG for use in the user interface (1730).

Although specific processes performed by the GW.OS to determine whether a gambling event is triggered for a sports event driven skilled interleaved game is described above with respect to FIG. 17, any of a variety of processes may be utilized to determine the results of gambling events in accordance with embodiments of the invention.

Figure 18:
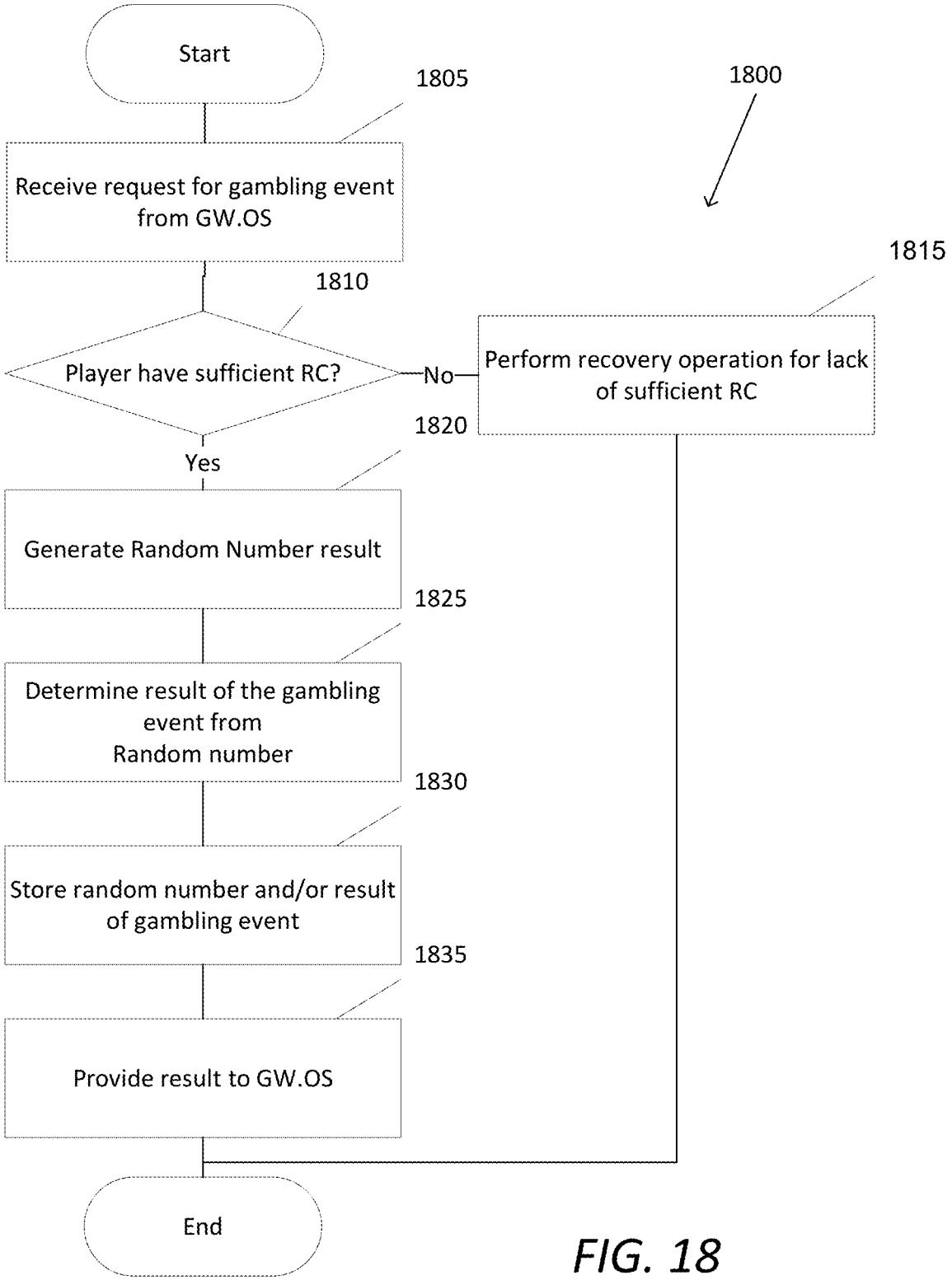
FIG. 18 illustrates a flow diagram of a process for resolving a gambling event in a gambling game performed by a real credit operating system in accordance with an embodiment of this invention.

A process performed by the RC.OS to determine the results of the gambling events and provide the results to the GW.OS in accordance with embodiments of this invention is shown in FIG. 18. In process 1800, the RC.OS receives a request for a gambling event in a gambling game from the GW.OS (1805). The request may include other information including, but not limited to, an amount to wager on the outcome of gambling event, a gambling game that is to be used, an indication of a proper RNG to use, and an indication of the pay tables to use to resolve the wager in a gambling game in accordance with some embodiments. The RC.OS determines whether the player has sufficient RC available to cover the wager (1810). If the player does not have sufficient RC to cover the wager, the RC.OS performs a recovery operation (1815). The recovery operation may prevent the wager from occurring or may allow the player to supply the necessary funds to cover the wager. If the player has sufficient RC, the RC.OS generates a random number result using the proper RNG (1820). The random number result is then used to determine the results of the gambling event and do all other appropriate operations for updating the RC available to the player (1825). The RC.OS may store the result and/or other information about the result, including the random number result, in a database for future use (1830). The RC.OS also provides the result of the gambling event to the GW.OS (1835).

Although specific processes performed by the RC.OS to determine the result of a gambling event in a gambling game for a sports event driven skilled interleaved game is described above with respect to FIG. 18, any of a variety of processes may be utilized to determine the results of gambling events in accordance with embodiments of the invention.

While the above description may include many specific embodiments of the invention, these should not be construed as limitations on the scope of the invention, but rather as an example of one embodiment thereof. It is therefore to be understood that the present invention can be practiced otherwise than specifically described, without departing from the scope and spirit of the present invention. Thus, embodiments of the present invention should be considered in all respects as illustrative and not restrictive.

What is claimed is:

1. A casino electronic game machine providing a sports event driven skill wagering interleaved game that includes a sports event driven entertainment game and a gambling game, comprising:

a real credit operating system comprising:

a real world credit meter;

a random number generator;

a real world credit pay table, wherein the real credit operating system is configured to:

receive real world credit from a portable media, wherein the portable media includes at least one member of a group including currency, a voucher and a smart card;

provide a randomly generated payout of real world credits from a wager of real world credits in the gambling game using the random number generator and real world credit pay table; and augment an amount of real world credits stored in the real world credit meter based on the randomly generated payout of real world credits to the real world credit meter;

an entertainment game system constructed to:

monitor a sporting event of interest to a user making wagers in the sports event driven entertainment game to detect an occurrence of an action in the sporting event of interest;

generate sports event update information that indicates the occurrence of the action in the sporting event of interest; and provide the sports event update information to a game world operating system;

a display screen configured to display at least one of gambling game results and wager outcomes based upon gambling event information;

a user input device configured to receive from a player a wagering amount to use during game play; and the game world operating system constructed to:

receive, from the entertainment game system, the sports event update information;

determine whether a gambling event is triggered from the occurrence of the action in the sporting event based upon the sports update information; and provide, to the real credit operating system, a trigger for the gambling event in response to a determination that the gambling event is triggered.

2. The casino electronic game machine of claim 1, wherein the sporting event of interest is a sporting contest.

3. The casino electronic game machine of claim 1, wherein the sporting event of interest is a simulated sporting contest.

4. The casino electronic game machine of claim 1, wherein the real credit operating system is further configured to provide, to the game world operating system, gambling event outcome information wherein the gambling event outcome information includes at least one of a gambling event result and a wager outcome.

5. The casino electronic game machine of claim 1, wherein the entertainment game system is further constructed to:

receive an input of gambling game options from a user wherein the gambling game options identify an action in the sporting event of interest;

provide, to the game world operating system, the gambling game options received; and receive, from the game world operating system, gambling event outcome information.

6. The casino electronic game machine of claim 5, wherein the sporting event of interest is a sporting contest.

7. The casino electronic game machine of claim 5, wherein the sporting event of interest is a simulated sporting contest.

8. The casino electronic game machine of claim 5, wherein the game world operating system is further constructed to:

generate the trigger for the gambling event in the gambling game based upon the action identified in the gambling game options; and provide, to the entertainment game system, the gambling event outcome information.

9. The casino electronic game machine of claim 8, wherein the gambling game options include one of a plurality of gambling games to associate with the action and wherein the trigger generated by the game world operating system for the gambling event also identifies the one of the plurality of gambling games for which the gambling event is triggered.

10. The casino electronic game machine of claim 8, wherein the gambling game options include a wager amount to wager on the result of the gambling event triggered by the action and wherein the trigger generated by the game world operating system for the gambling event also includes the wager amount for the triggered gambling event.

11. The casino electronic game machine of claim 8, wherein the gambling game options includes a plurality of actions for the sporting event of interest and a particular one of a plurality of gambling games to associate with each of the plurality of actions wherein the trigger generated by the game world operating system includes one of the plurality of actions and the particular one of the gambling games associated with the action.

* * * * *